US008052248B2

(12) United States Patent
Ogata

(10) Patent No.: US 8,052,248 B2
(45) Date of Patent: Nov. 8, 2011

(54) LIQUID EJECTION HEAD AND IMAGE FORMING APPARATUS

(75) Inventor: Kenichi Ogata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 225 days.

(21) Appl. No.: 12/357,755

(22) Filed: Jan. 22, 2009

(65) Prior Publication Data

US 2009/0189958 A1 Jul. 30, 2009

(30) Foreign Application Priority Data

Jan. 28, 2008 (JP) ..... 2008-016709

(51) Int. Cl.
*B41J 2/14* (2006.01)
*B41J 2/045* (2006.01)

(52) U.S. Cl. ..... 347/47; 347/70

(58) Field of Classification Search ..... 347/47, 347/68–72

See application file for complete search history.

(56) References Cited

U.S. PATENT DOCUMENTS

| | | | | |
|---|---|---|---|---|
| 6,074,039 | A * | 6/2000 | Kishima et al. | 347/45 |
| 6,729,716 | B2 | 5/2004 | Eguchi et al. | |
| 7,264,338 | B2 | 9/2007 | Ogata et al. | |
| 2004/0109047 | A1 * | 6/2004 | Tobita et al. | 347/68 |

FOREIGN PATENT DOCUMENTS

| | | | |
|---|---|---|---|
| JP | 2001-270116 | | 10/2001 |
| JP | 3454833 | | 7/2003 |
| JP | 2004-160941 | | 6/2004 |
| JP | 2005-34997 | | 2/2005 |
| JP | 2007-69545 | | 3/2007 |
| JP | 2007-210310 | * | 8/2007 |

* cited by examiner

*Primary Examiner* — Geoffrey Mruk
(74) *Attorney, Agent, or Firm* — Cooper & Dunham LLP

(57) ABSTRACT

Disclosed is a liquid ejection head that includes a flow path member having provided therein plural liquid chambers respectively in communication with plural nozzles that eject a liquid droplet and are arranged side by side; a vibration plate member that forms at least a part of wall surfaces of the liquid chambers; plural piezoelectric element columns that deform the vibration plate member at positions corresponding to the liquid chambers; a supporting column that corresponds to a partition wall sandwiched between the liquid chambers; and a base member on which the plural piezoelectric element columns and the supporting column are arranged. The supporting column is arranged so as to be sandwiched between a group of two or more of the consecutive piezoelectric element columns in a nozzle arrangement direction.

16 Claims, 23 Drawing Sheets

LIQUID EJECTION HEAD AND IMAGE FORMING APPARATUS

BACKGROUND OF THE INVENTION

1. Technical Field

This disclosure relates to a liquid ejection head and an image forming apparatus.

2. Description of the Related Art

As image forming apparatuses such as printers, facsimile machines, copiers, plotters, and multi-task machines having plural such functions, ink jet recording apparatuses of a liquid ejection recording type using a recording head that ejects, for example, ink liquid droplets are known. The image forming apparatus of this type ejects ink droplets onto a sheet during conveyance from the recording head to perform image formation (used synonymously with recording, printing, and imaging). Examples of the image forming apparatus include a serial-type image forming apparatus in which the recording head ejects liquid droplets to form an image while moving in a main scanning direction and a line-type image forming apparatus using a line-type head in which the recording head ejects liquid droplets to form an image without moving.

Note that in the present invention, the "image forming apparatus" refers to an apparatus that shoots ink droplets onto a medium such as paper, a thread, a fiber, a fabric, leather, metal, a plastic, glass, wood, and a ceramic so as to perform the image formation. Furthermore, the "image formation" refers to forming on the medium not only relevant images such as characters and graphics, but also irrelevant images such as random patterns (i.e., liquid droplets are just ejected and shot out). Furthermore, the "ink" is not limited to one as generally called ink, but it is used as a generic name of various liquid available for the image formation such as recording liquid, fixing treatment liquid, and liquid. Furthermore, the material of the "sheet" is not limited to paper. That is, the sheet refers to ones including an OHP sheet, a fabric, etc., onto which ink droplets are ejected, and it is used as a generic name of one including a medium to be recorded, a recording medium, a recording sheet, a recording paper, etc.

As liquid ejection heads, piezoelectric-type liquid ejection heads using a piezoelectric-type actuator are known. In this liquid ejection head, plural liquid chambers are independently provided for each of the nozzles arranged in parallel that eject ink droplets, and at least a part of wall surfaces of the plural liquid chambers is formed by a vibration plate. When ejecting ink droplets, the liquid ejection head deforms the vibration plate with piezoelectric elements and changes the volumes of the liquid chambers.

As described in Patent Document 1, such a piezoelectric-type liquid ejection head uses, for example, lamination-type piezoelectric elements. The liquid ejection head includes a flow path member having plural liquid chambers respectively in communication with plural nozzles that eject liquid droplets and are arranged side by side; a vibration member that forms at least a part of the wall surfaces of the liquid chambers; plural piezoelectric element columns composed of lamination-type piezoelectric elements that deform each of the vibration plates corresponding to the liquid chambers; and a base member on which plural piezoelectric elements are arranged.

Patent Document 1: JP-A-2007-069545

In addition, as described in Patent Document 1, it is known that such a liquid ejection head has a bi-pitch structure in which piezoelectric element columns and supporting columns are alternately arranged between the base member and the flow path member at a nozzle arrangement interval. Alternatively, it is known that such a liquid ejection head has a normal-pitch structure in which the piezoelectric element columns are arranged between the base member and the flow path member at the nozzle arrangement interval.

Note that as for the piezoelectric-type liquid ejection head, the following Patent Documents are also known.

Patent Document 2: JP-A-2001-270116

Patent Document 3: JP-A-2004-160941

Patent Document 4: JP-A-2005-034997

Patent Document 5: JP-B2-3454833

Due to the alternate arrangement of the piezoelectric element columns and the supporting columns driven, it is difficult to realize high density in the liquid ejection head having the bi-pitch structure. That is, because the piezoelectric element columns and the supporting columns are arranged relative to a desired nozzle arrangement interval (nozzle pitch), the widths of the piezoelectric element columns and the supporting columns in a nozzle arrangement direction become narrow. As a result, the piezoelectric element columns and the supporting columns are easily damaged during processing, and their bonding strength with the base member is easily reduced.

On the other hand, because the supporting columns are not arranged between the piezoelectric element columns in the liquid ejection head having the normal-pitch structure, the nozzle pitch and the arrangement interval of the piezoelectric element columns can be made the same, which makes it possible to arrange the nozzles at high density. However, due to the absence of the supporting columns between the piezoelectric elements, the liquid ejection head having the normal-pitch structure is likely to cause mutual interference compared with the liquid ejection head having the bi-pitch structure. Specifically, when the liquid ejection head ejects liquid droplets, the piezoelectric element columns expand to thereby upthrust the whole flow path member. As a result, liquid droplet ejection performance from the nozzles is degraded, and meniscus of the nozzles that do not eject liquid droplets is broken. Particularly, when liquid droplets are ejected from a large number of nozzles, the mutual interference becomes pronounced. As a result, the liquid droplet ejection performance is fluctuated.

According to Patent Documents 3 and 4, in order to prevent the mutual interference, the positions of penetrated parts (parts connected to the nozzles of the liquid chambers) of the adjacent liquid chambers are displaced so as to prevent the reduction in rigidity of the parts. Such a method is effective only for the mutual interference between the adjacent liquid chambers (called "adjacent mutual interference"), but it is not effective for the mutual interference caused by upthrusting the flow path member.

SUMMARY OF THE INVENTION

In an aspect of this disclosure, there is provided an approach for improving operability while reducing mutual interference, in a liquid ejection head and an image forming apparatus.

According to another aspect, there is provided a liquid ejection head including a flow path member having provided therein plural liquid chambers respectively in communication with plural nozzles that eject a liquid droplet and are arranged side by side; a vibration plate member that forms at least a part of wall surfaces of the liquid chambers; plural piezoelectric element columns that deform the vibration plate member at positions corresponding to the liquid chambers; a supporting column that corresponds to a partition wall sandwiched between the liquid chambers; and a base member on which the plural piezoelectric element columns and the supporting column are arranged. The supporting column is arranged so as to be sandwiched between a group of two or more of the consecutive piezoelectric element columns in a nozzle arrangement direction.

Preferably, two or more of the piezoelectric element columns may be arranged so as to be sandwiched between two of the supporting columns.

Preferably, an arrangement interval of the nozzles may be different from an arrangement interval of the piezoelectric element columns. In this case, the liquid chambers may have a part facing the nozzle and a part facing the piezoelectric element column. In addition, the liquid chambers may incline toward the part facing the piezoelectric element column from the part facing the nozzle.

Preferably, two of the piezoelectric element columns may be arranged between two of the supporting columns and axisymmetrically arranged.

Preferably, the plural nozzles may be arranged so as to be displaced from each other in a direction orthogonal to the nozzle arrangement direction, and a distance in the direction orthogonal to the nozzle arrangement direction may not be an integral multiple of a pitch between recording dots when a recording operation is performed with the liquid ejection head. In this case, the plural nozzles may be arranged in two rows in a staggered manner, and a distance L in the direction orthogonal to the nozzle arrangement direction may be expressed by a formula $L=p\times(n+\frac{1}{2})$ where n is an integer and p is the pitch between the recording dots. In addition, the nozzles in one row and the nozzles in the other row may be arranged on the same side of the liquid chambers relative to the arrangement of the piezoelectric element columns. Alternatively, the nozzles in one row and the nozzles in the other row may be arranged on opposite sides of the liquid chambers relative to the arrangement of the piezoelectric element columns.

According to another aspect of this disclosure, there is provided an image forming apparatus having the liquid ejection head described above.

The aforementioned liquid ejection head has the plural piezoelectric element columns that deform the vibration plate at the positions corresponding to the liquid chambers and the supporting columns corresponding to the partition wall sandwiched between the liquid chambers. With the configuration in which one supporting column is sandwiched between a group of two or more consecutive piezoelectric element columns in the nozzle arrangement direction, the liquid ejection head can improve operability of the piezoelectric element columns while reducing mutual interference Accordingly, the image forming apparatus can stably form a high-quality image along with reduced mutual interference.

The aforementioned and other aspects, features and advantages will become more apparent from the following detailed description when read in conjunction with the accompanying drawings.

DETAILED DESCRIPTION OF THE PREFERRED EMBODIMENTS

Figure 1:
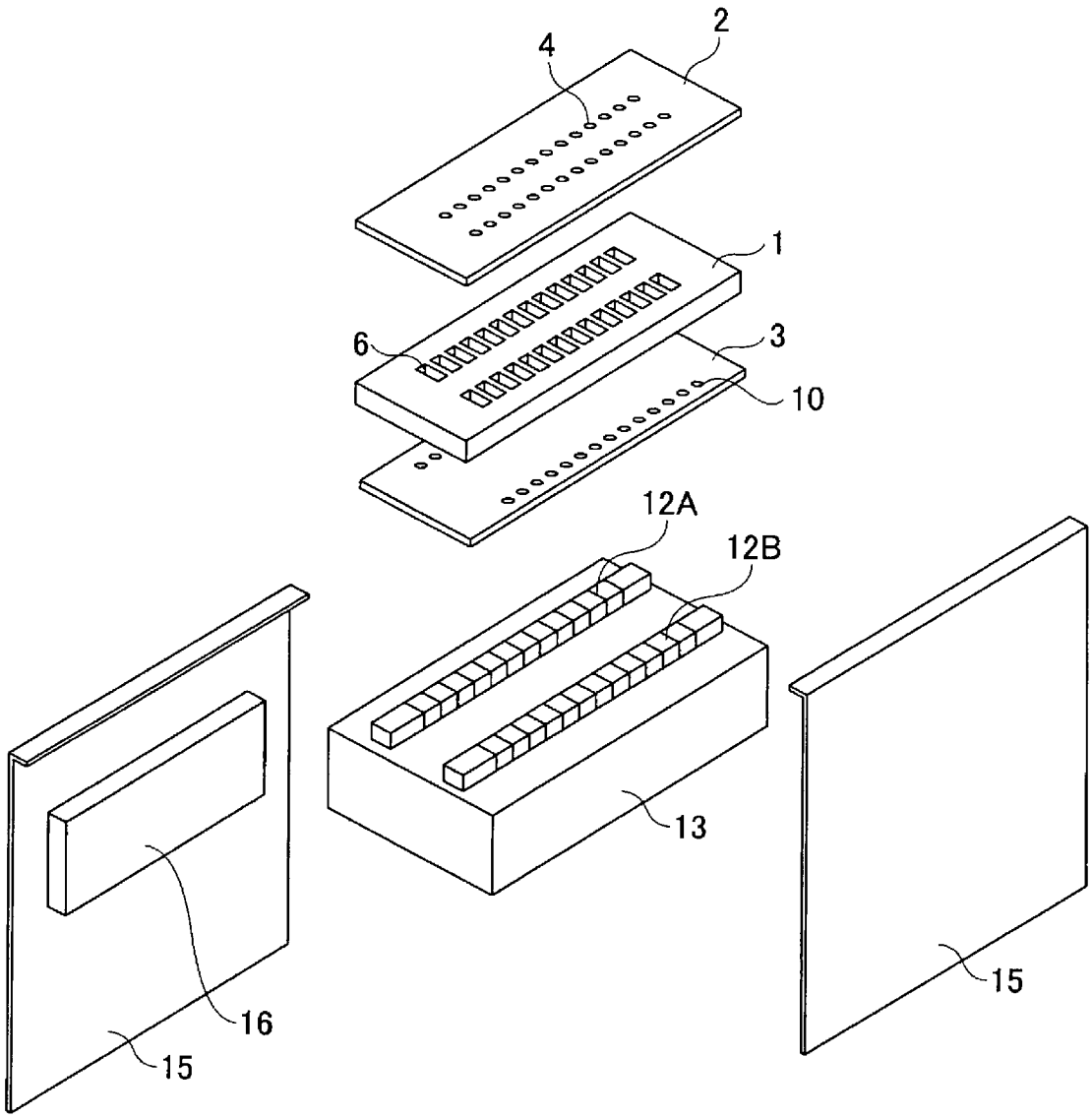
FIG. 1 is an exploded perspective view of a liquid ejection head according to a first embodiment of the present invention.
Figure 2:
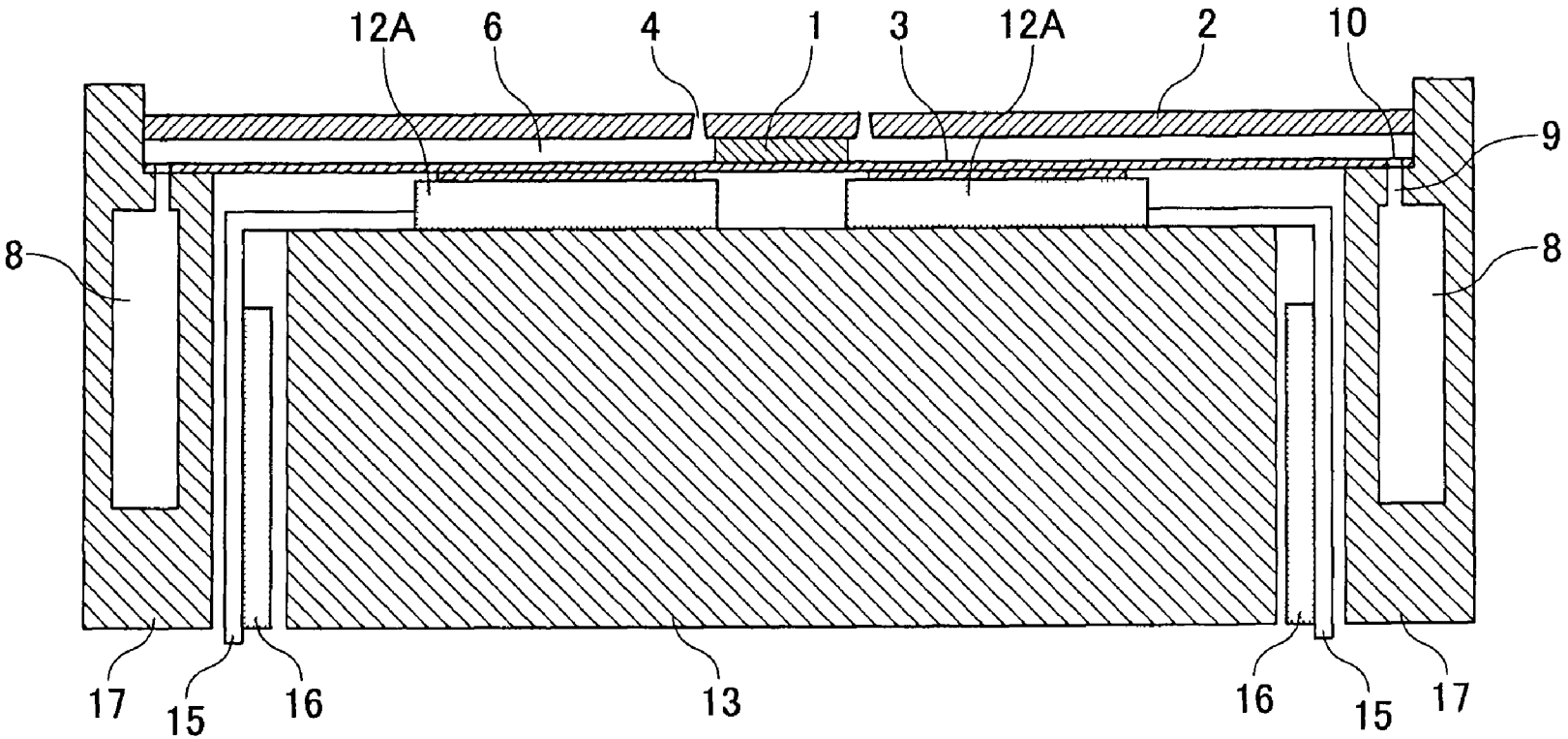
FIG. 2 is a cross-sectional view along a direction (longitudinal direction of liquid chambers) orthogonal to the nozzle arrangement direction of the liquid ejection head.
Figure 3:
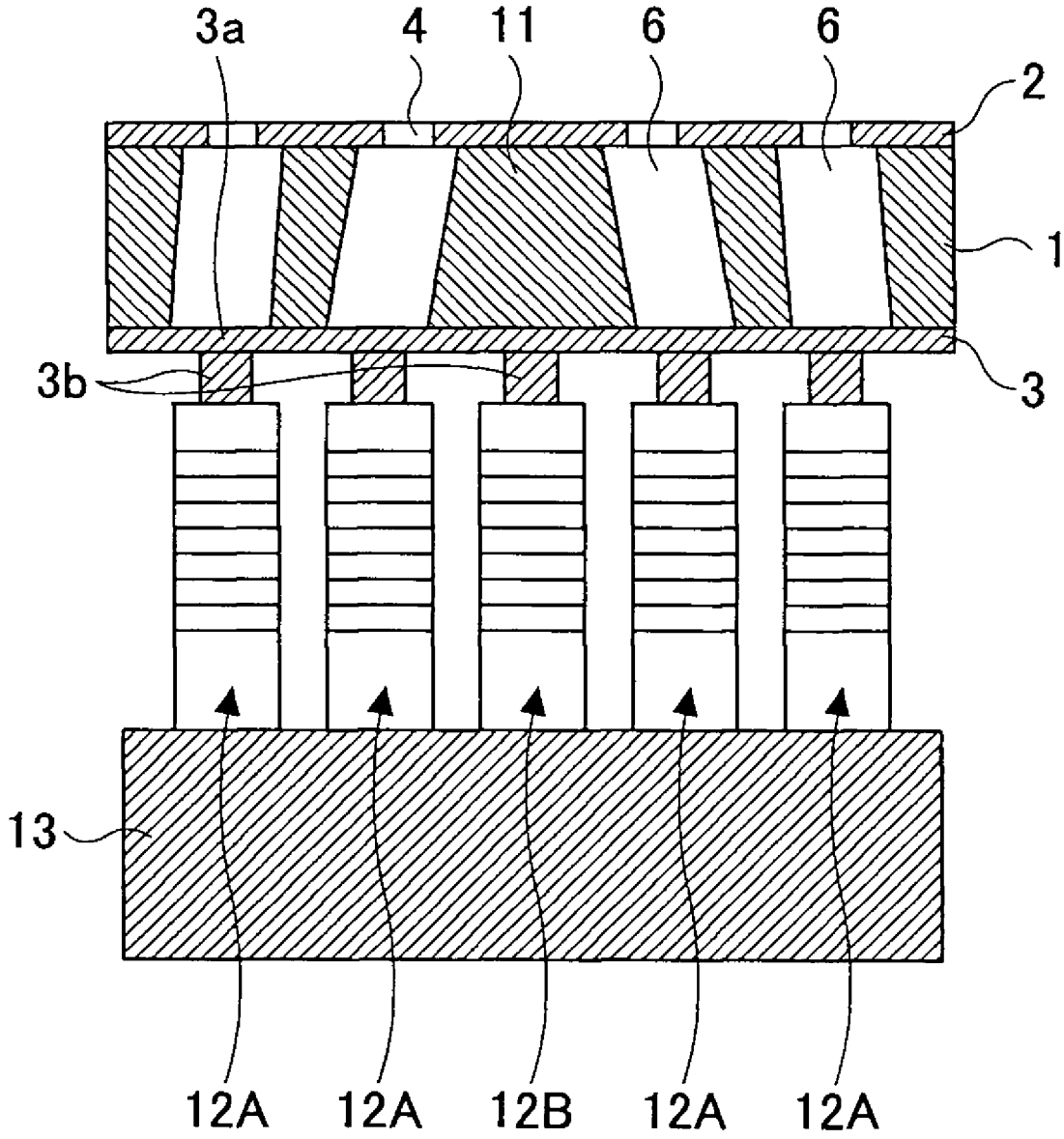
FIG. 3 is a cross-sectional view along the nozzle arrangement direction (lateral direction of the liquid chambers) of the liquid ejection head.

Next, referring to the accompanying drawings, embodiments of the present invention are described. Referring first to FIGS. 1 through 3, a first embodiment of a liquid ejection head according to the present invention is described. Note that FIG. 1 is an exploded perspective view of the liquid ejection head, FIG. 2 is a cross-sectional view along a direction (longitudinal direction of liquid chambers) orthogonal to the nozzle arrangement direction of the liquid ejection head, and FIG. 3 is a cross-sectional view along the nozzle arrangement direction (lateral direction of the liquid chambers) of the liquid ejection head.

The liquid ejection head has a flow path plate 1 as a flow path member, a vibration plate member 3 that is bonded to the lower surface of the flow path plate 1, and a nozzle plate 2 as a nozzle member that is bonded to the upper surface of the flow path plate 1. With this configuration, the liquid ejection head has plural liquid chambers 6 (also called pressurizing liquid chambers, pressure chambers, pressurizing chambers, flow paths, etc.) in communication with plural nozzles 4 that eject ink droplets. Ink is supplied from common liquid chambers 8 provided in frame members 17 to be described below to the liquid chambers 6 via a communication part 9 and a supplying port 10 provided in the vibration plate member 3.

The nozzle plate 2 is a metal plate made, for example, of nickel (Ni) and manufactured by the electroforming method (electrocasting), but the material and configuration of the nozzle plate 2 are not limited to this. The nozzle plate 2 has the plural nozzles 4 having a diameter of 10 through 35 μm in two rows and is bonded to the flow path plate 1 by an adhesive. In addition, the nozzle plate 2 has a water-repellent layer on the side of a surface (a front surface in an ejecting direction, i.e., an ejection surface, or a surface opposite to the liquid chambers 6) from which liquid droplets are ejected.

The vibration plate member 3 has vibration areas (diaphragm parts) 3*a* forming wall surfaces corresponding to the respective liquid chambers 6 and has island-shaped convex portions (connecting portions) 3*b* on the outside of the surfaces (on the side of the surface opposite to the liquid chambers 6) of the vibration areas 3*a*. In addition, the vibration plate member 3 has the connecting portions 3*b* also at areas corresponding to partition walls 11 between the liquid chambers 6 that partition the liquid chambers 6 in the nozzle arrangement direction.

On the other hand, on a base member (supporting substrate) 13, plural piezoelectric element columns 12A and plural supporting columns 12B are provided in a bonded state. The plural piezoelectric element columns 12A are composed of a lamination-type piezoelectric element member as a driving unit (an actuator unit, a pressure generating unit) that deforms the vibration areas 3*a* of the vibration plate member 3. The plural supporting columns 12B are composed of a lamination-type piezoelectric element members that support the flow path plate 1. The upper end surfaces of the piezoelectric element columns 12A and the supporting columns 12B are bonded to the connecting portions 3*b* of the vibration plate member 3.

Note that the piezoelectric element columns 12A and the supporting columns 12B are formed in such a manner that lamination-type piezoelectric element members in which piezoelectric material layers and internal electrodes are alternately laminated are grooved with full-cut dicing and are arranged at a predetermined interval. A driving signal is not applied to the piezoelectric element columns as the supporting columns 12B. Therefore, the supporting columns 12B serve as members that only support the flow path plate 1.

Moreover, in order to supply a driving signal, FPCs (Flexible Printed Circuit Boards) 15 are connected to the piezoelectric element columns 12A by solder bonding, ACF (Anisotropic Conductive Film), or wire bonding. The FPCs 15 have mounted thereon a driving circuit (driver IC) 16 that selectively applies a driving waveform to the piezoelectric element columns 12A.

On the peripheral side of an actuator part composed of the piezoelectric element columns 12A, the supporting columns 12B, the base member 13, the FPCs 15, etc., frame members 17 formed by injection molding using an epoxy system resin or polyphenylene sulfite are arranged. The frame members 17 are bonded to the base member 13 by an adhesive at the periphery of the flow path plate 1 and the vibration plate member 3. As described above, the common liquid chambers 8 are provided in the frame members 17. In the common liquid chambers 8, a supplying path (communication pipe) not shown is provided so as to receive ink from the outside. This supplying path is connected to an ink supplying source not shown.

Note that in this liquid ejection head, the nozzles 4 are arranged in two rows, the liquid chambers 6 are arranged in two rows so as to correspond to the nozzles, and the piezoelectric element columns 12A and the supporting columns 12B are arranged in two rows. However, the configuration of the liquid ejection head is not limited to this. For example, the nozzles 4, the piezoelectric element columns 12A, and the supporting columns 12B may be arranged in a row or in three or more rows. In addition, the base member 13 may be divided for each row.

When the liquid ejection head thus configured is driven, for example, by a push ejection system, a controlling part not shown causes a driving pulse voltage of 20 V through 50 V to be selectively applied to the piezoelectric element columns 12A in accordance with an image to be recorded. Then, the piezoelectric element columns 12A to which the driving pulse voltage is applied is displaced to thereby deform the vibration areas 3*a* of the vibration plate member 3 toward the nozzle plate 2. As the volumes of the liquid chambers 6 change, the liquid in the liquid chambers 6 are pressurized. As a result, liquid droplets are ejected from the nozzles 4 of the nozzle plate 2. Then, the pressure in the liquid chambers 6 decreases along with the ejection of the liquid droplets. The inertia caused by the flow of ink at this time generates small negative pressure in the liquid chambers 6. When the application of the voltage to the piezoelectric element columns 12A is stopped in this state, the vibration plate member 3 is returned to an initial position, which in turn restores the liquid chambers 6. As a result, further negative pressure is generated in the liquid chambers 6. At this time, ink is supplied from the common liquid chambers 8 to the liquid chambers 6, and liquid droplets are ejected from the nozzles 4 in accordance with the application of the next driving pulse.

Note that besides the push ejection system, the liquid ejection head may be driven by a pull ejection system (in which the vibration areas 3*a* of the vibration plate member 3 are made open in a pulled state to perform pressurization with its restoring force), a pull and push ejection system (in which the vibration plate areas 3*a* held at an intermediate position is pulled and pushed), etc.

Referring here to FIG. 3, a description is specifically made of an arrangement relationship between the piezoelectric element columns 12A and the supporting columns 12B in the liquid ejection head and the structure of the liquid chambers 6.

In the relationship between the piezoelectric element columns 12A and the supporting columns 12B arranged on the base member 13, one supporting column 12B is sandwiched between a group of two or more consecutive piezoelectric element columns 12A in a nozzle alignment direction (the same as the nozzle arrangement direction). In other words, in an example shown in FIG. 3, one supporting column 12B is arranged so as to be sandwiched between the group of two or more consecutive piezoelectric element columns 12A. As for the number of the piezoelectric element columns 12A and the supporting columns 12B arranged on the base member 13, the supporting columns 12B is smaller in number than the piezoelectric element columns 12A by "two" or more.

In this case, the proportion of the number of the supporting columns 12B to the number of the piezoelectric element columns 12A is varied depending on the configuration of the liquid ejection head. However, if the liquid ejection head is configured to have a density of 300 dpi, it is preferred to arrange one supporting column 12B relative to two through four piezoelectric element columns 12A. As described above, in the example shown in FIG. 3, the two piezoelectric element columns 12A are arranged on both sides of the one supporting column 12B in a sandwiched manner.

Accordingly, some partition walls 11 are fixed onto the base member 13 via the supporting columns 12B, and others are not fixed onto the base member 13.

Here, it is preferable that the piezoelectric element columns 12A and the supporting columns 12B be arranged at even intervals and that the nozzles 4 be arranged at even intervals. In this case, if the nozzles 4 are arranged above the piezoelectric element columns 12A, the arrangement intervals of the plural piezoelectric element columns 12A become uneven and thus different from the arrangement intervals of the nozzles 4. Therefore, in this embodiment, in order to obtain a corresponding relationship between the piezoelectric element columns 12A and the nozzles 4, penetrated parts of the flow path plate 1 constituting the liquid chambers 6 are formed so as to be inclined in the nozzle arrangement direction (nozzle alignment direction).

As described above, the one supporting column 12B is arranged so as to be sandwiched between the group of two or more consecutive piezoelectric element columns 12A in the nozzle alignment direction.

Figure 23:
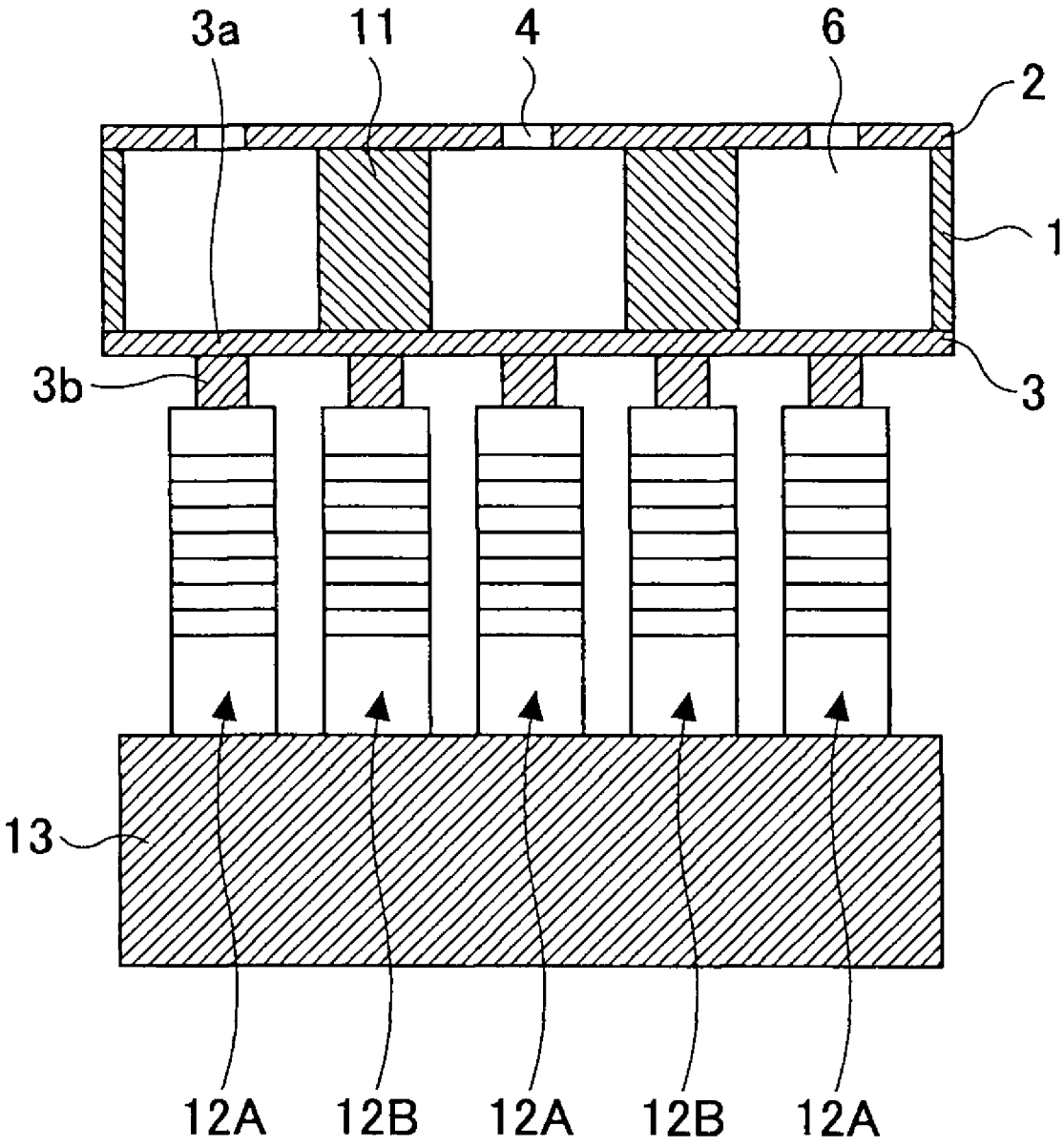
FIG. 23 is a cross-sectional view for explaining a liquid ejection head having a bi-pitch structure.

Accordingly, compared with a liquid ejection head having a bi-pitch structure (an example shown in FIG. 23) in which the piezoelectric element columns 12A and the supporting columns 12B are alternately arranged, the arrangement intervals of the nozzles 4 (nozzle pitches) can be smaller in size, that is, the nozzles 4 can be arranged at higher density in the liquid ejection head of this embodiment on the condition that the widths of the piezoelectric element columns 12A and the supporting columns 12B in the nozzle arrangement direction are the same. Conversely, if the nozzle pitches are the same, it is possible to increase the widths of the piezoelectric element columns 12A and the supporting columns 12B in the nozzle arrangement direction. As a result, it is possible to reduce damages on the piezoelectric element columns 12, falling of the piezoelectric element columns 12, etc., during its processing. Therefore, workability of the liquid ejection head is improved.

On the other hand, some of the partition walls 11 of the flow path plate 1 are fixed onto the base member 13 via the supporting columns 12B. Therefore, compared with a liquid ejection head having a normal pitch structure (an example shown in FIG. 24) in which no supporting columns 12B are arranged, the liquid ejection head of this embodiment can reduce mutual interference caused to upthrust the flow path plate 1 at the time of driving the piezoelectric element columns 12A.

As described above, the liquid ejection head has the plural piezoelectric element columns 12A each deforming the vibration plate member 3 corresponding to the liquid chambers 6 and the supporting columns 12B corresponding to the partition walls 11 adjacent to each other. According to this configuration of the liquid ejection head, the one supporting column 12B is arranged so as to be sandwiched between the group of two or more consecutive piezoelectric element columns 12A in the nozzle arrangement direction. As a result, it is possible to improve workability while reducing the mutual interference, which in turn can realize the liquid ejection head having the nozzles at high density that provides secured liquid ejection performance.

Figure 4:
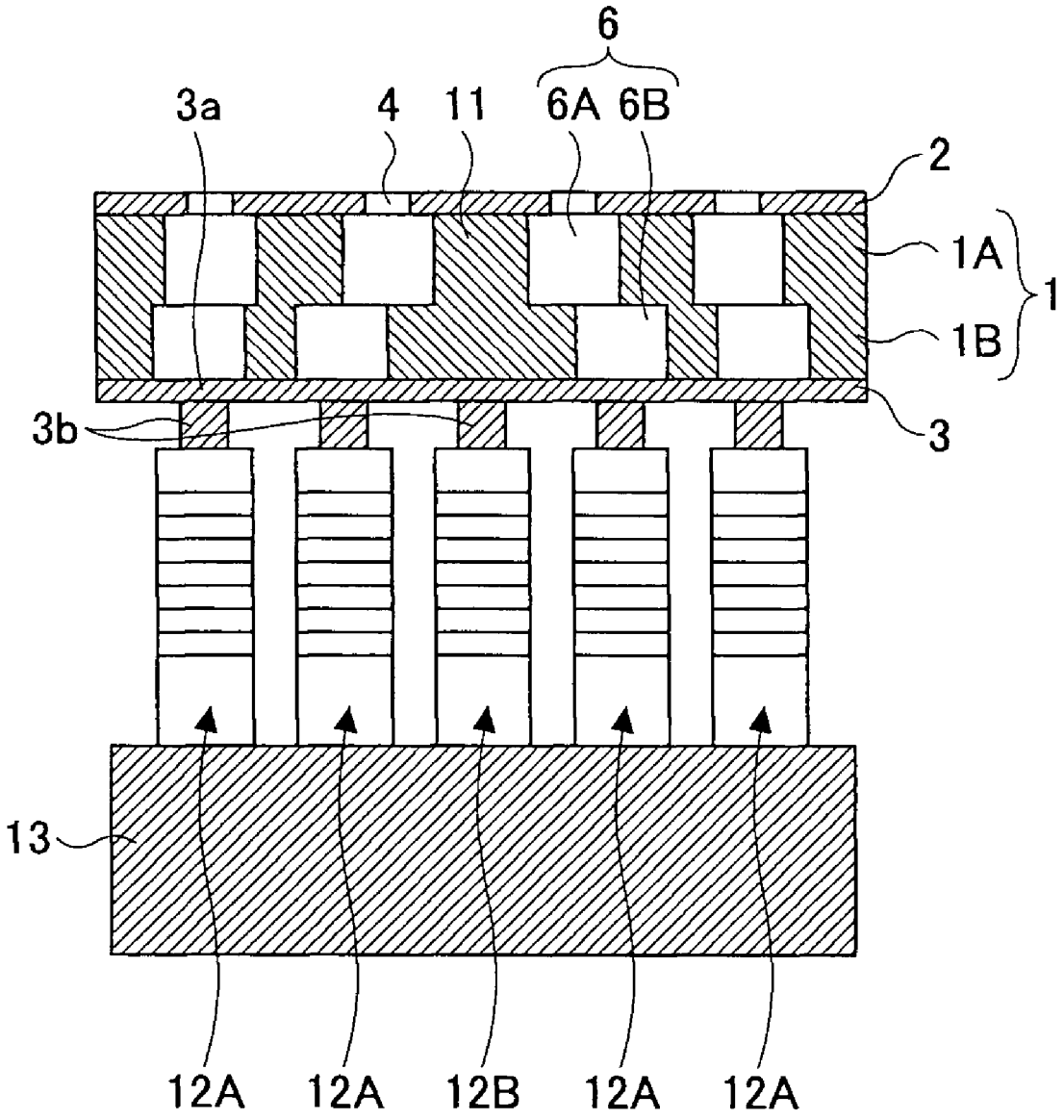
FIG. 4 is a cross-sectional view of the liquid ejection head according to a second embodiment of the present invention taken along the line X1-X1 in FIG. 5.
Figure 5:
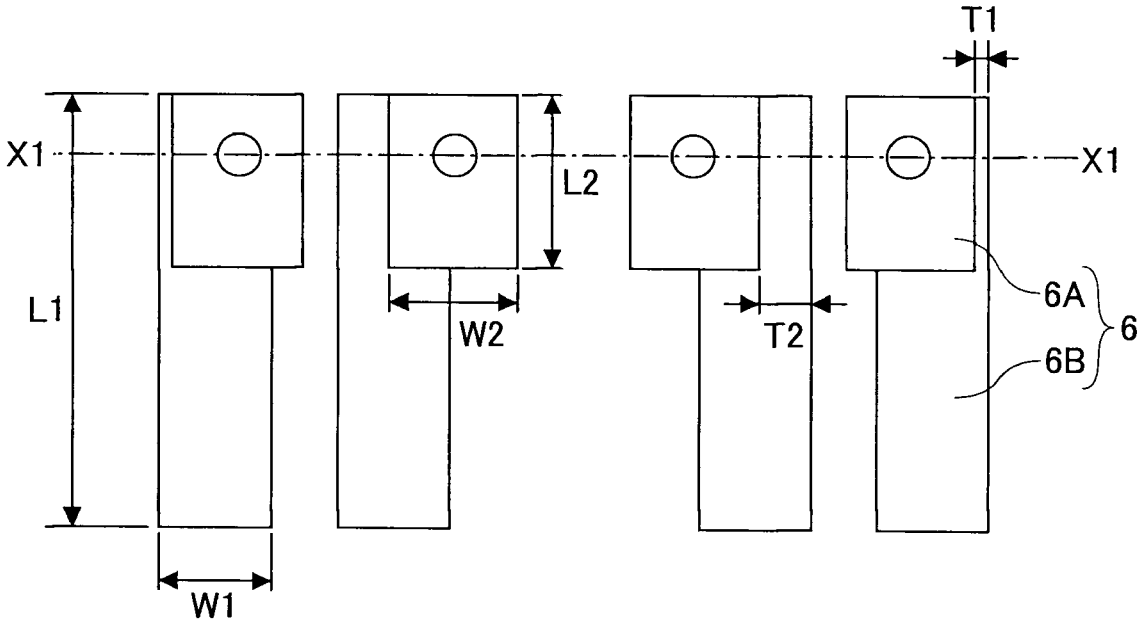
FIG. 5 is a plan view of the liquid ejection head according to the second embodiment of the present invention.

Referring next to FIGS. 4 and 5, a second embodiment of the liquid ejection head according to the present invention is described. Note that FIG. 4 is a cross-sectional view of the liquid ejection head taken along the line X1-X1 in FIG. 5, and FIG. 5 is a plan view of the liquid ejection head.

In this embodiment, the flow path plate 1 has a double-layered structure in which a first layer (upper layer) 1A and a second layer (lower layer) 1B are integrally formed. In the first layer 1A, liquid chamber parts 6A having a length of L2 and a width of W2 are formed so as to face the nozzles 4. Furthermore, in the second layer 1B, liquid chamber parts 6B having a length of L1 and a width of W1 are formed so as to face the piezoelectric element columns 12A via the vibration plate areas 3*a*. The liquid chamber parts 6A and the liquid chamber parts 6B are displaced from each other by a predetermined amount T1 or T2 in the nozzle arrangement direction. Note that the nozzles 4 are arranged at even intervals. Accordingly, even if the arrangement pitches (intervals) of the nozzles 4 are different from the arrangement pitches (intervals) of the piezoelectric element columns 12A, it is possible to make the nozzles 4 correspond to the piezoelectric element columns 12A.

Figure 6:
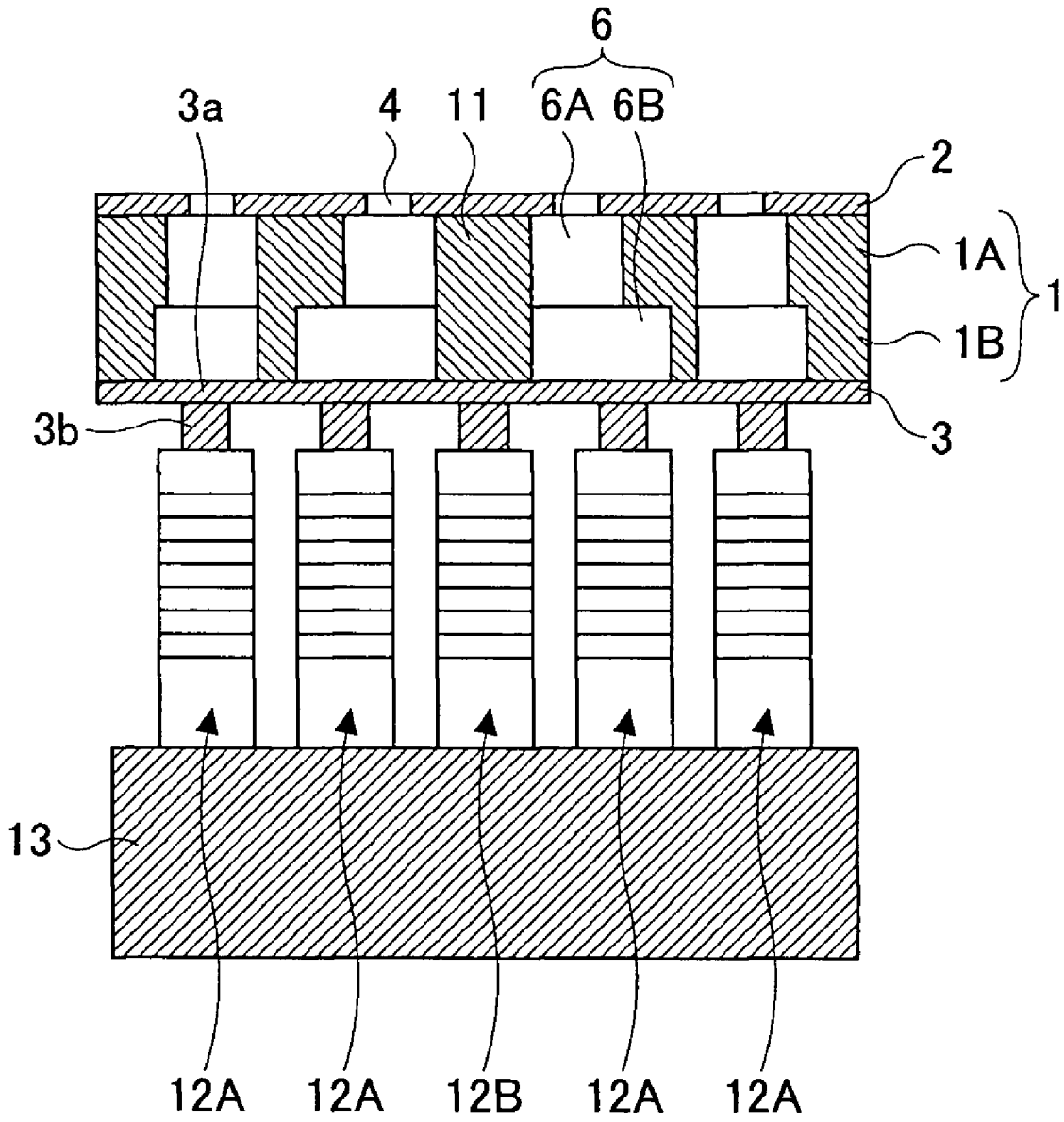
FIG. 6 is a cross-sectional view along the nozzle arrangement direction of the liquid ejection head according to a third embodiment of the present invention.

Referring next to FIG. 6, a third embodiment of the liquid ejection head according to the present invention is described. Note that FIG. 6 is a cross-sectional view along the nozzle arrangement direction of the liquid ejection head.

In this embodiment, the liquid chamber parts 6A of the first layer 1A are penetrated into the liquid chamber parts 6B of the second layer 12B. Accordingly, even if the arrangement pitches of the nozzles 4 are different from the arrangement pitches of the piezoelectric element columns 12A, it is possible to make the nozzles 4 correspond to the piezoelectric element columns 12A.

Figure 7:
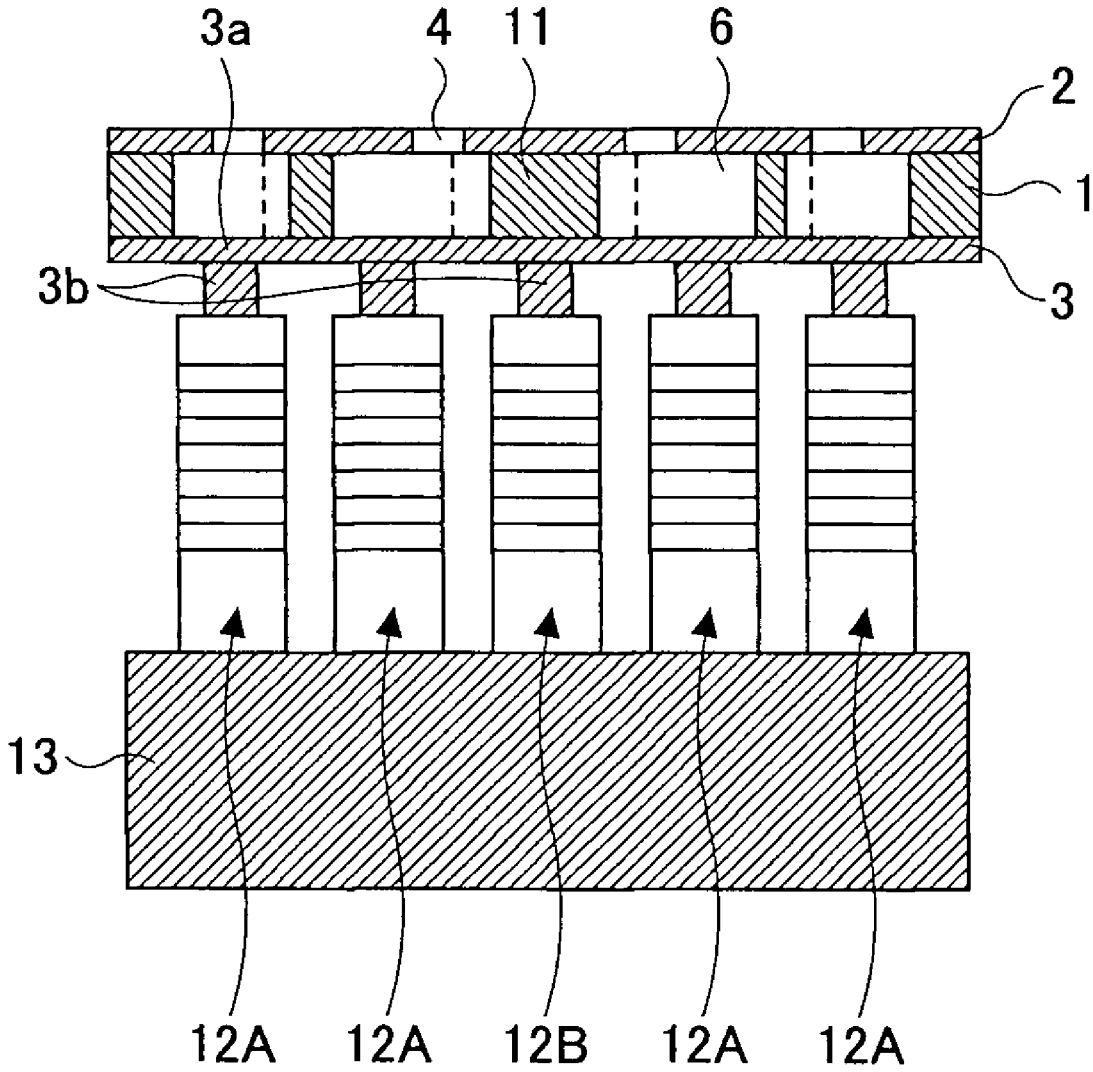
FIG. 7 is a cross-sectional view along the nozzle arrangement direction of the liquid ejection head according to a fourth embodiment of the present invention.
Figure 8:
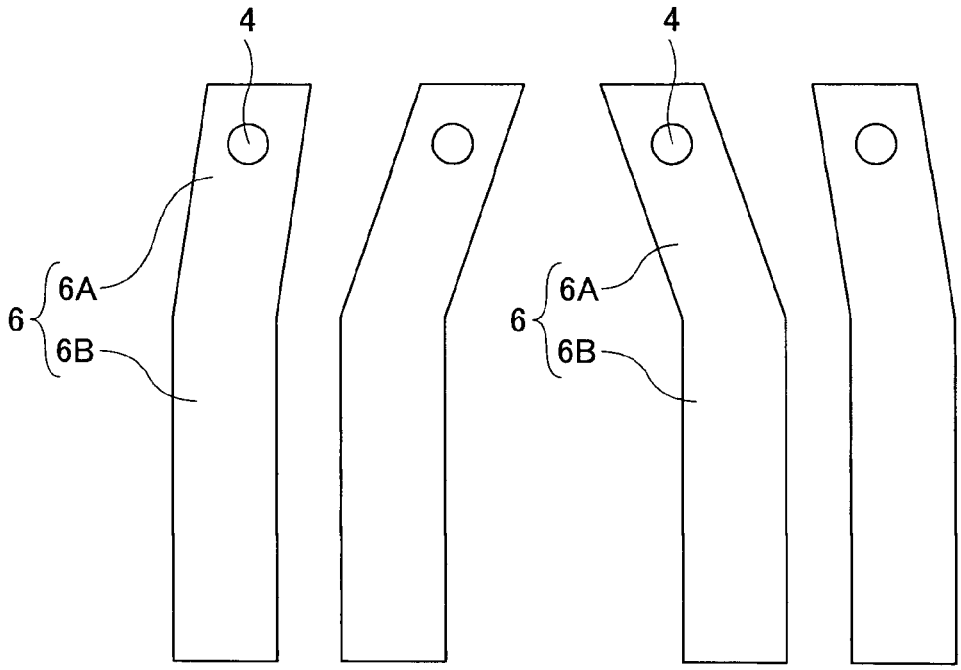
FIG. 8 is a plan view showing the shapes of the liquid chambers of the liquid ejection head according to the fourth embodiment of the present invention.

Referring next to FIGS. 7 and 8, a fourth embodiment of the liquid ejection head according to the present invention is described. Note that FIG. 7 is a cross-sectional view along the nozzle arrangement direction of the liquid ejection head, and FIG. 8 is a plan view showing the shapes of the liquid chambers 6 of the liquid ejection head.

In this embodiment, the liquid chambers 6 are formed such that the liquid chamber parts 6A facing the nozzles 4 linearly incline toward the liquid chamber parts 6B facing the piezoelectric element columns 12A. Accordingly, even if the arrangement pitches of the nozzles 4 are different from the arrangement pitches of the piezoelectric element columns 12A, it is possible to make the nozzles 4 correspond to the piezoelectric element columns 12A.

Figure 9:
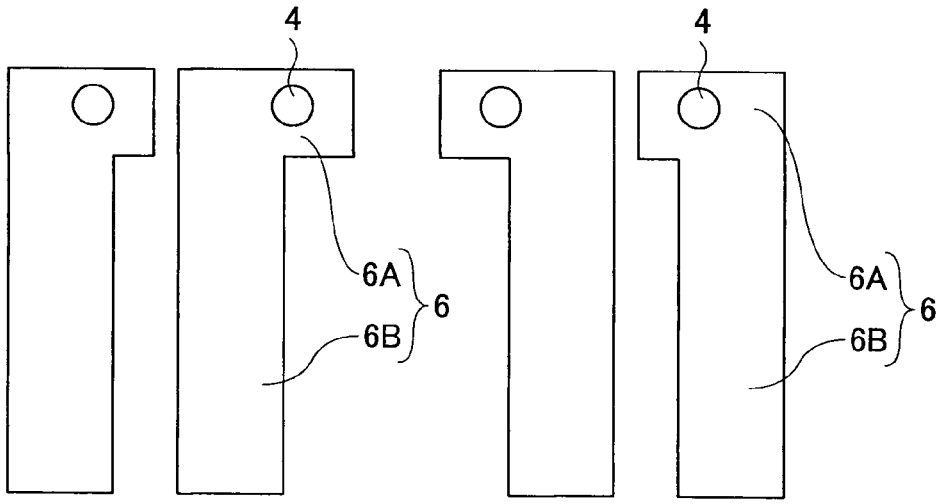
FIG. 9 is a plan view showing the shapes of the liquid chambers of the liquid ejection head according to a fifth embodiment of the present invention.

Referring next to FIG. 9, a fifth embodiment of the liquid ejection head according to the present invention is described. Note that FIG. 9 is a plan view showing the shapes of the liquid chambers 6 of the liquid ejection head.

In this embodiment, the liquid chamber parts 6B corresponding to the piezoelectric element columns 12A are linearly connected to the liquid chamber parts 6A corresponding to the nozzles 4. Accordingly, even if the arrangement pitches of the nozzles 4 are different from the arrangement pitches of the piezoelectric element columns 12A, it is possible to make the nozzles 4 correspond to the piezoelectric element columns 12A. Note that although the flow path plate 1 has a single-layered structure, it may have a double-layered structure.

Figure 10:
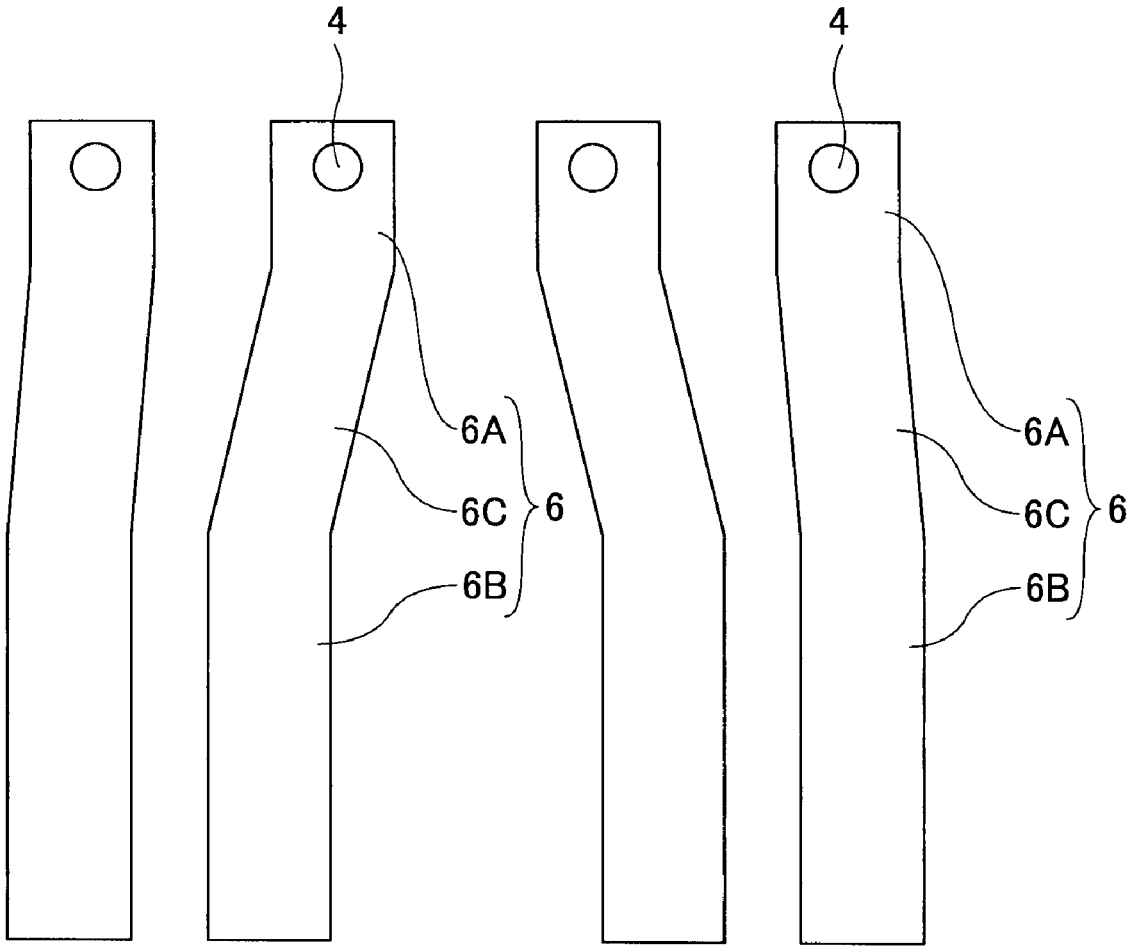
FIG. 10 is a plan view showing the shapes of the liquid chambers of the liquid ejection head according to a sixth embodiment of the present invention.

Referring next to FIG. 10, a sixth embodiment of the liquid ejection head according to the present invention is described. Note that FIG. 10 is a plan view showing the shapes of the liquid chambers 6 of the liquid ejection head.

In this embodiment, the liquid chambers 6 have inclined parts 6C between the liquid chamber parts 6B corresponding to the piezoelectric element columns 12A and the liquid chamber parts 6A corresponding to the nozzles 4. The liquid chambers 6 linearly incline in a stepwise manner. Accordingly, even if the arrangement pitches of the nozzles 4 are different from the arrangement pitches of the piezoelectric element columns 12A, it is possible to make the nozzles 4 correspond to the piezoelectric element columns 12A. In this case, the liquid chamber parts 6A, the inclined parts 6C, and the liquid chamber parts 6B may be connected to each other in an inclined manner.

Figure 11:
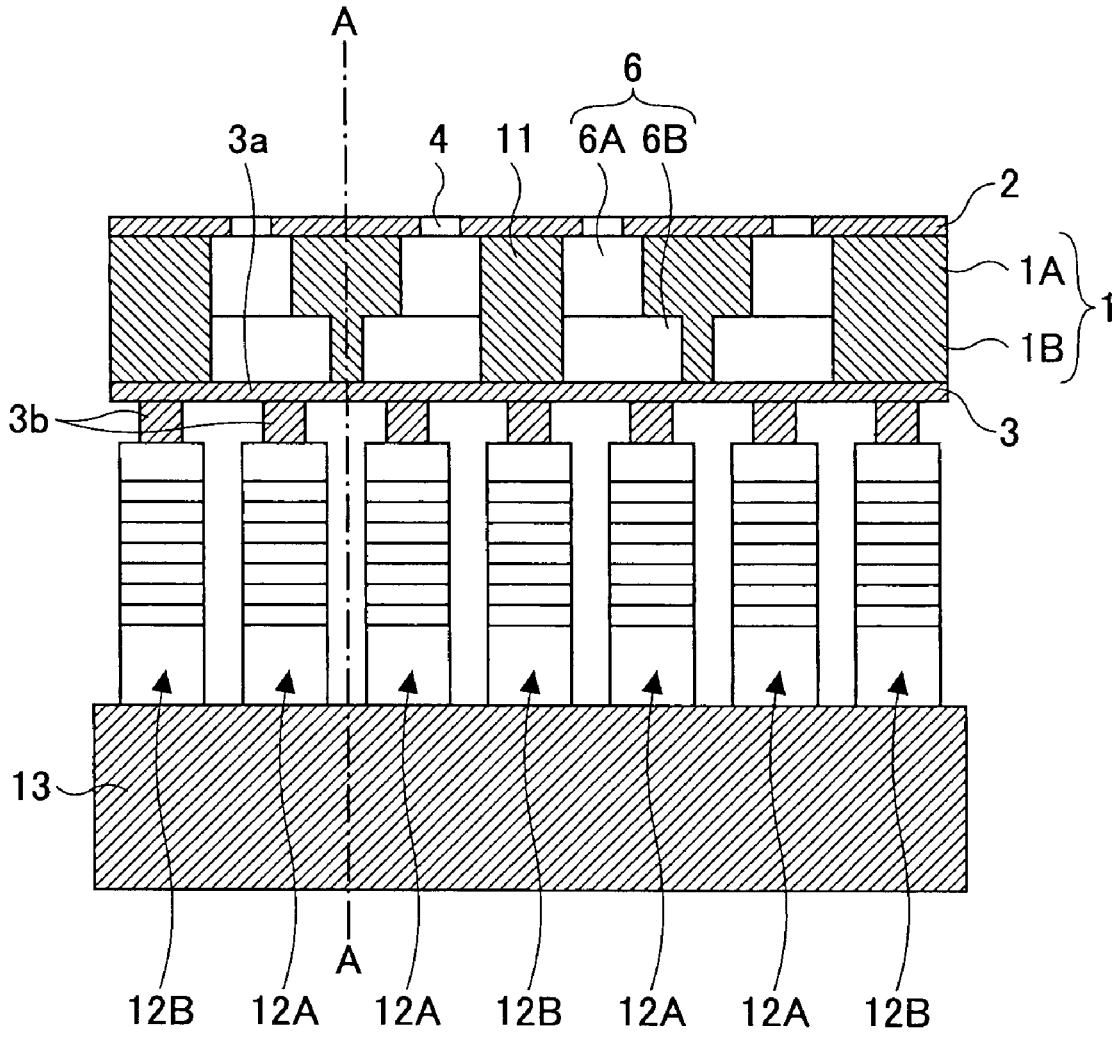
FIG. 11 is a cross-sectional view along the nozzle arrangement direction of the liquid ejection head according to a seventh embodiment of the present invention.
Figure 12:
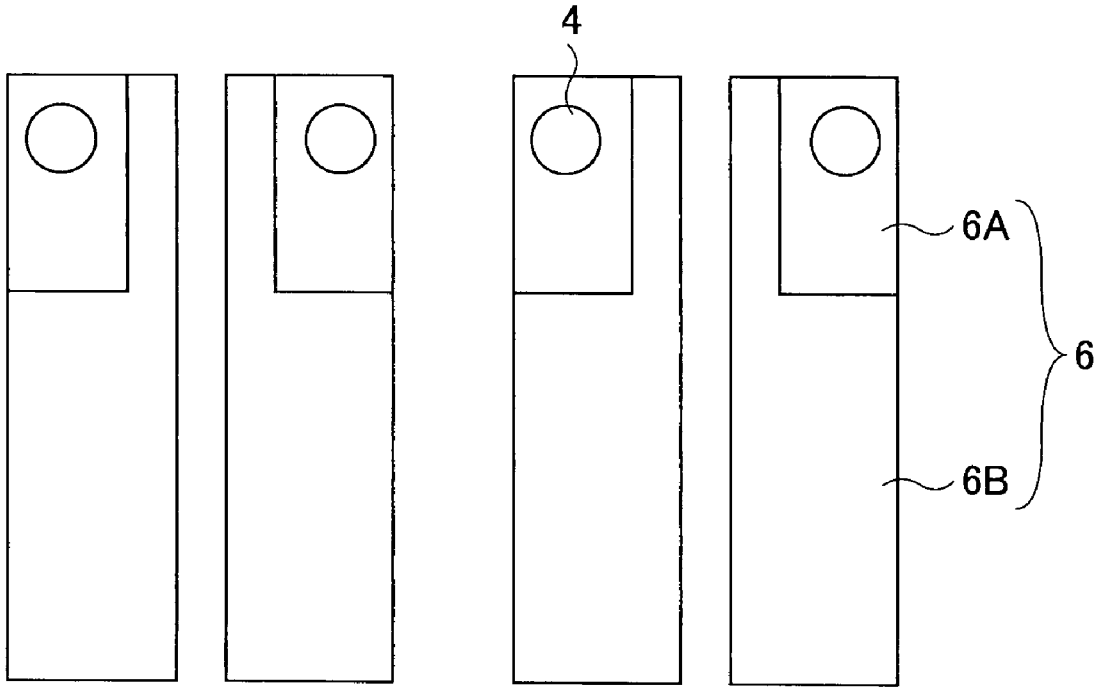
FIG. 12 is a plan view showing the shapes of the liquid chambers of the liquid ejection head according to the seventh embodiment of the present invention.

Referring next to FIGS. 11 and 12, a seventh embodiment of the liquid ejection head according to the present invention is described. Note that FIG. 11 is a cross-sectional view along the nozzle arrangement direction of the liquid ejection head, and FIG. 12 is a plan view showing the shapes of the liquid chambers 6.

In this embodiment, similarly to the case of the first embodiment, the one supporting column 12B is sandwiched between the group of two or more consecutive piezoelectric element columns 12A in the nozzle arrangement direction. However, when viewed on the basis of the supporting columns 12B, the two piezoelectric element columns 12A are sandwiched between the two supporting columns 12B.

With this configuration, it is possible to axisymmetrically arrange the two adjacent liquid chambers 6 which correspond to the two piezoelectric element columns 12A adjacent to each other based on the line A-A shown in FIG. 11 as an axis of symmetry. Therefore, all the liquid chambers 6 can be the same in shape. As a result, it becomes possible to obtain uniform performance for ejecting liquid droplets ejected from all bits (all nozzles) without making corrections using driving waveforms.

In the case of this configuration, the arrangement density of the piezoelectric element columns 12A and the supporting columns 12B is 1.5 times as large as the arrangement density of the nozzles 4. For example, if the nozzles 4 are arranged at a density of 300 dpi, the piezoelectric element columns 12A and the supporting columns 12B are arranged at a density of 450 dpi.

Figure 13:
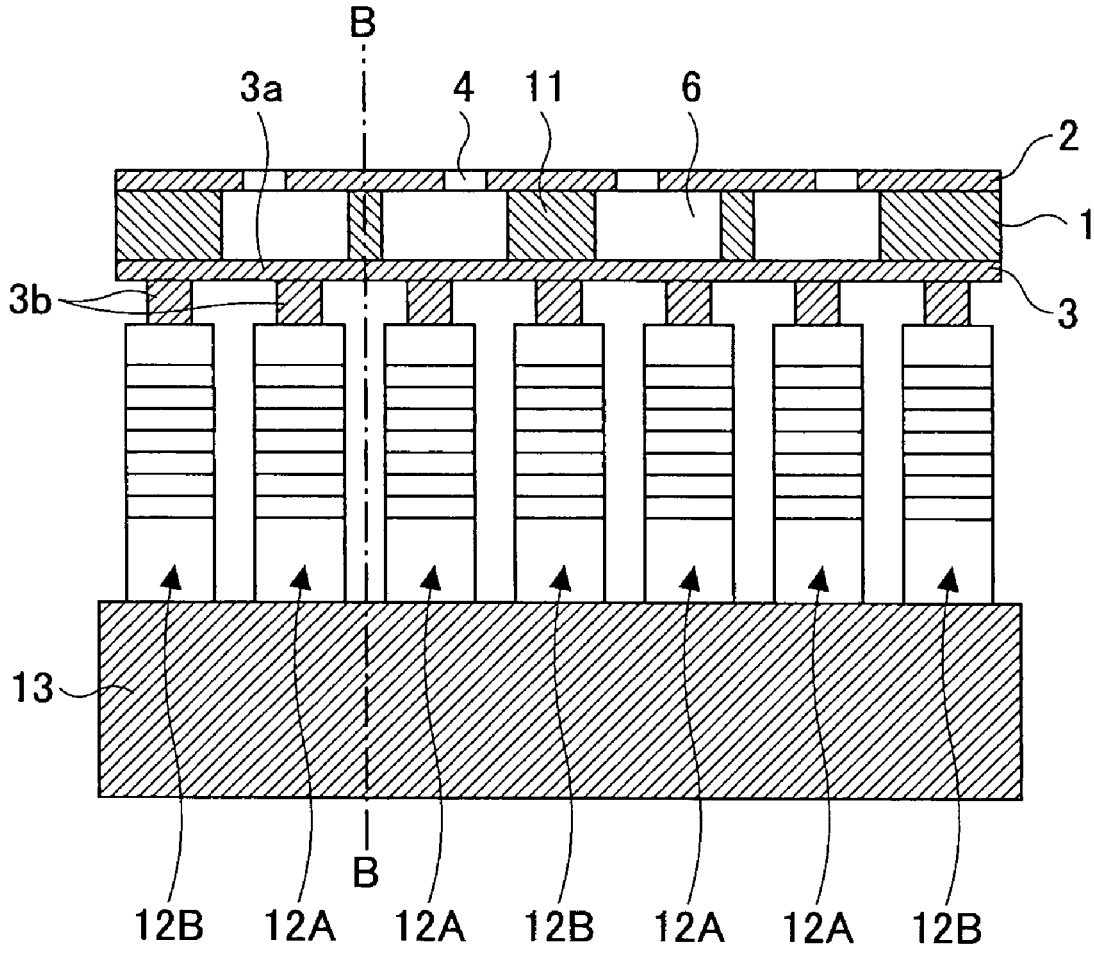
FIG. 13 is a cross-sectional view along the nozzle arrangement direction of the liquid ejection head according to an eighth embodiment of the present invention.
Figure 14:
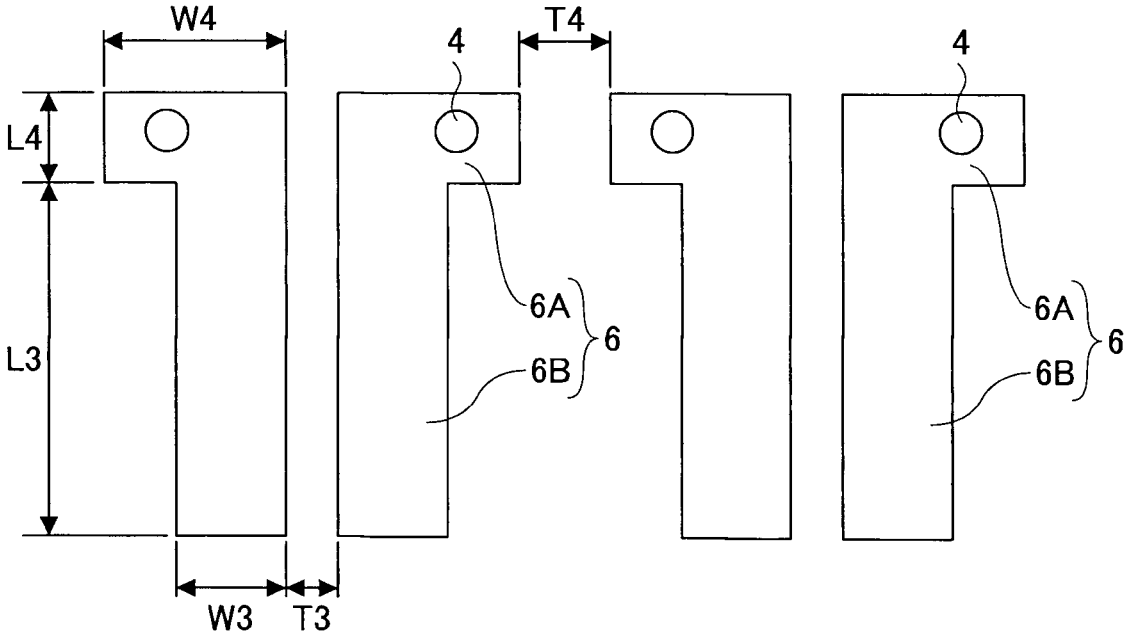
FIG. 14 is a plan view showing the shapes of the liquid chambers of the liquid ejection head according to the eighth embodiment of the present invention.

Referring next to FIGS. 13 and 14, an eighth embodiment of the liquid ejection head according to the present invention is described. Note that FIG. 13 is a cross-sectional view along the nozzle arrangement direction of the liquid ejection head, and FIG. 14 is a plan view showing the shapes of the liquid chambers 6 of the liquid ejection head.

In this embodiment, similarly to the case of the fifth embodiment, the liquid chambers 6 are composed of the liquid chamber part 6A having a length L4 and a width W4 and the liquid chamber part 6B having a length L3 and a width W3. However, similarly to the case of the seventh embodiment, because the two piezoelectric element columns 12A are sandwiched between the two supporting columns 12B, it is possible to axisymmetrically arrange the adjacent liquid chambers 6 based on the line B-B as an axis of symmetry. Note that in this embodiment, the liquid chambers 6 corresponding to the adjacent piezoelectric element columns 12A are arranged at an interval T3, and the liquid chambers 6 corresponding to the adjacent piezoelectric element columns 12A via the supporting column 12B are arranged at an interval T4.

Figure 15:
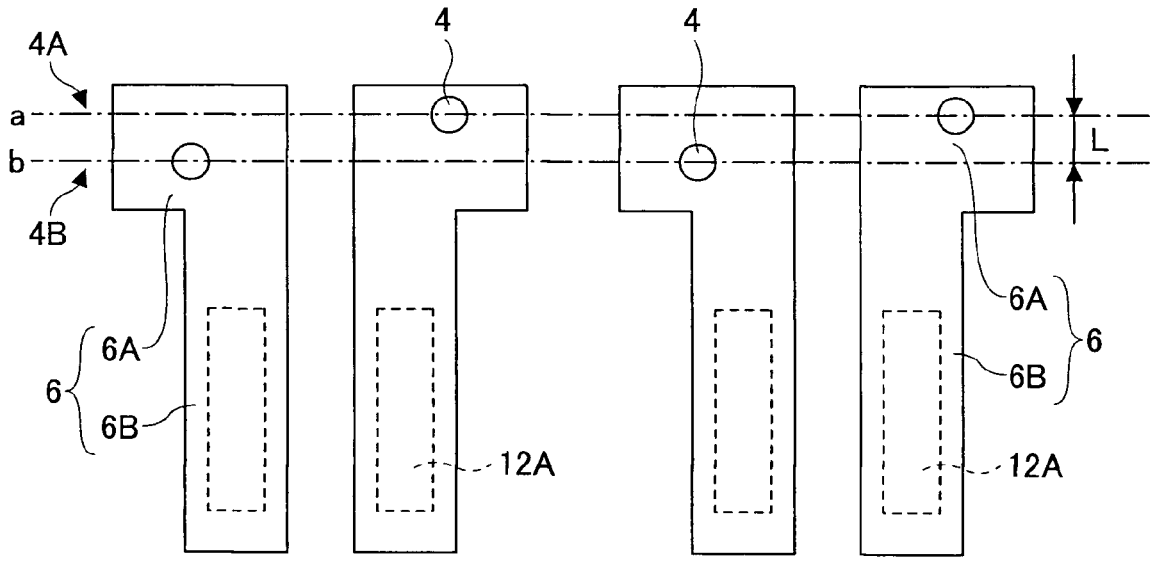
FIG. 15 is a plan view showing the shapes of the liquid chambers of the liquid ejection head according to a ninth embodiment of the present invention.

Referring next to FIG. 15, a ninth embodiment of the liquid ejection head according to the present invention is described. Note that FIG. 15 is a plan view showing the shapes of the liquid chambers 6 of the liquid ejection head.

In this embodiment, the liquid chambers 6 are the same in shape as the liquid chambers 6 of the eighth embodiment. Furthermore, in the liquid chambers 6 of the liquid ejection head, the adjacent nozzles 4 are displaced from each other by a distance L in a direction (corresponding to the recording direction during a recording operation) orthogonal to the nozzle arrangement direction and arranged in a staggered manner. In this case, the distance L between the a nozzle row 4A as indicated by a line "a" and a nozzle row 4B as indicated by a line "b" is set so as not to be an integral multiple of the pitch between recording dots.

In this regard, a description is made by referring to FIGS. 16 through 18A and 18B.

Figure 16:
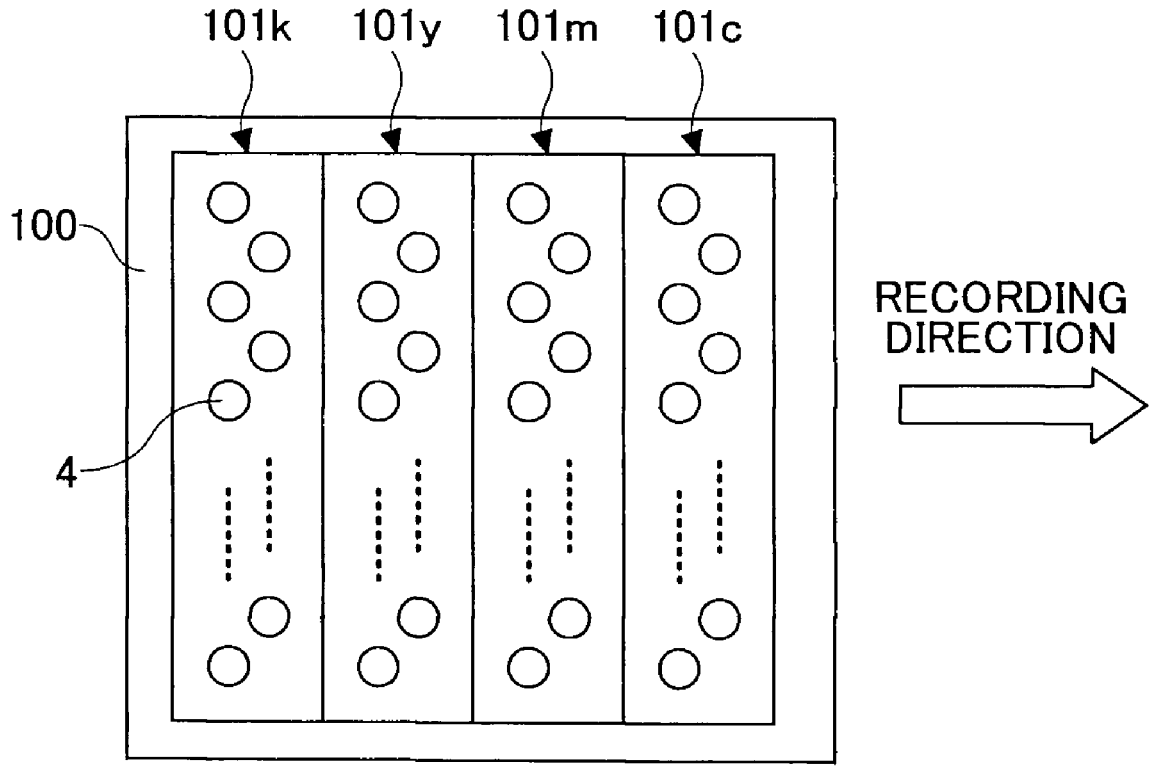
FIG. 16 is a view of the liquid ejection head mounted on a carriage for explaining the ninth embodiment of the present invention.

As shown in FIG. 16, head units 101*k*, 101*y*, 101*m*, and 101*c* for four colors of the liquid ejection head of the ninth embodiment are mounted on a carriage 100 in a direction (a sheet feeding direction) in which each of the nozzle rows 4A and 4B is orthogonal to a recording direction. When the liquid ejection head performs a recording operation, the carriage 100 is caused to scan in the recording direction. Note that the number of the head units 101 is not limited to four, and the number of the nozzle rows of the head unit 101 is not limited to two. Furthermore, in the case of a line-type liquid ejection head that is not mounted on a carriage, the carriage is not caused to move. In this case, however, a direction orthogonal to a direction along the nozzle rows 4A and 4B is defined as the recording direction.

If the distance L between the nozzle rows 4A and 4B in the recording direction is an integral multiple of the pitch between recording dots, the adjacent nozzles 4 may eject liquid droplets at the same time (the same applies to the liquid ejection head of the second embodiment in which the nozzles 4 are arranged in line).

Figure 17B:
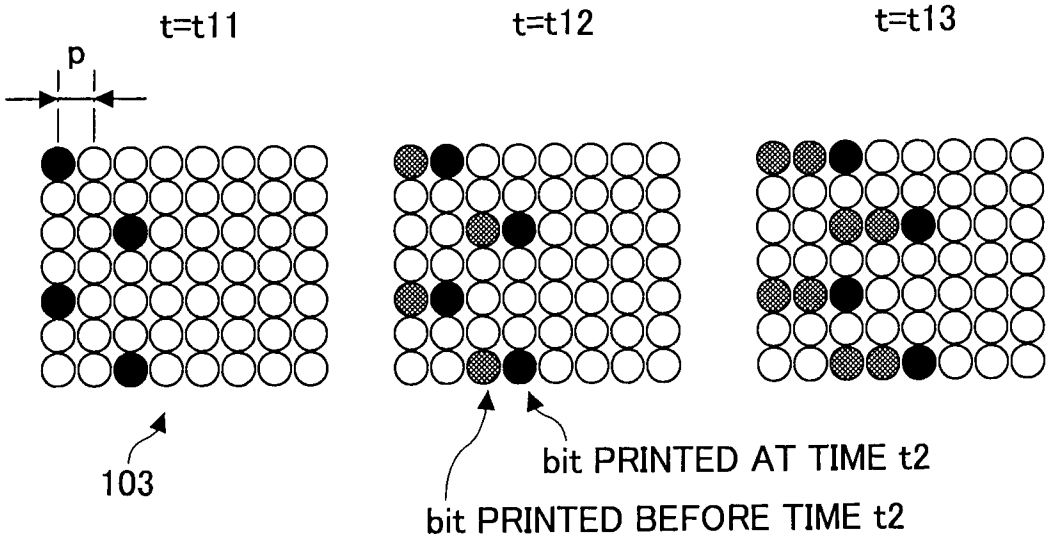
FIGS. 17A and 17B are views for explaining printing in a comparative example.
Figure 17A:
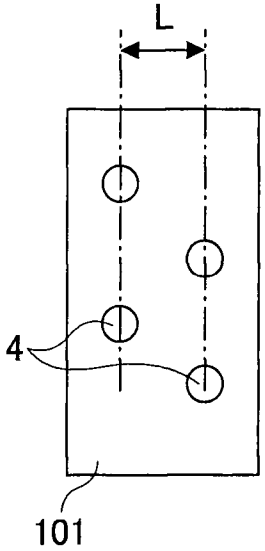

Referring next to FIGS. 17A, 17B, 18A, and 18B, a description is specifically made of this phenomenon. Here, let it be assumed that solid printing, i.e., printing of a print image 103 is performed in which all the bits (dots) of an object to be printed are filled. As shown in FIGS. 17A and 17B, when a printing operation is performed at a recording dot of 600 dpi, the length of the pitch "p" (dot interval) of a recording head is 42.3 μm. However, if the distance L between the nozzle rows shown in FIG. 17A is two times (84.6 μm) as large as the pitch p (L=2 p), liquid droplets are ejected from all the nozzles 4 at the same time during the printing operation with times t11, t12, and t13. In other words, the adjacent liquid chambers 6 eject liquid droplets at the same time. For this reason, mutual interference caused by the adjacent liquid chambers 6 and mutual interference caused by upthrusting the flow path plate 1 are likely to occur. Note that in FIG. 17B, black circles represent dots printed by liquid droplets ejected at the times, and gray circles represent dots printed by liquid droplets ejected before the times.

Figure 18B:
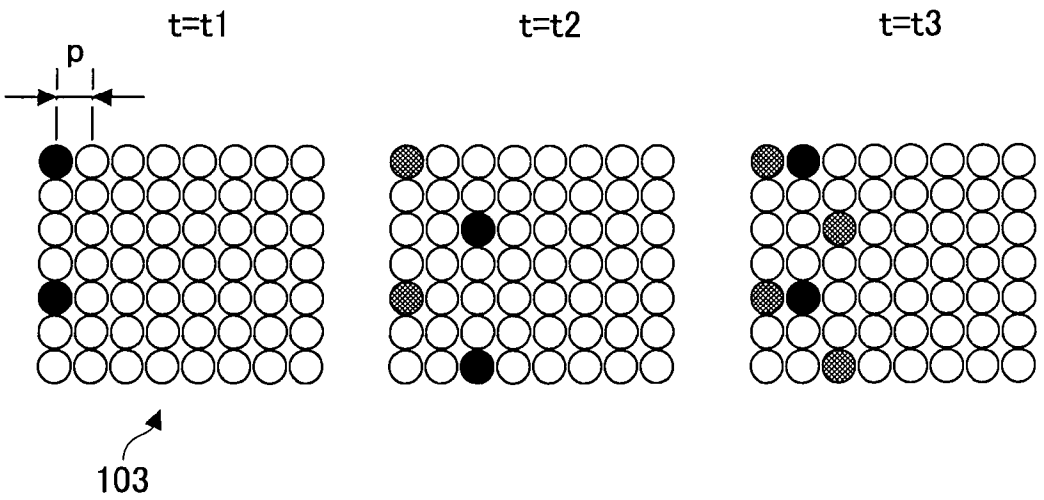
FIGS. 18A and 18B are views for explaining the printing according to the embodiment of the present invention.
Figure 18A:
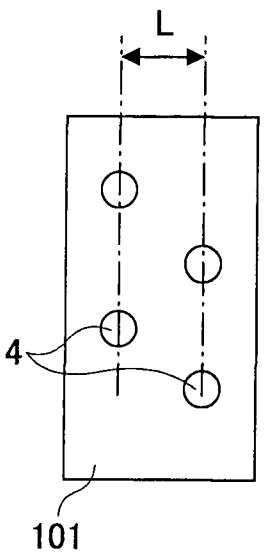

On the other hand, as shown in FIGS. 18A and 18B, if the distance L between the nozzle rows is 1.5 times (63.5 μm) as large as the pitch p (L=1.5 p), only half the nozzles 4 (for one row) are caused to move to an ejection point at the time t1. Therefore, liquid droplets are ejected from the nozzles 4 for the one row. Then, at the time t2, i.e., after the head unit 201 moves in the recording direction from the time t1 by an amount of "42.3 μm×0.5," liquid droplets are ejected from the remaining half of the nozzles 4. Moreover, at the time t3, i.e., after the head unit 201 moves in the recording direction from the time t2 by the amount of "42.3 μm×0.5," liquid droplets are ejected onto dots between the dots printed at the times t1 and the dots printed at the time t2 from the remaining half of the nozzles 4. As described above, the nozzles 4 of the adjacent liquid chambers 6 do not eject liquid droplets at the same time. As a result, mutual interference further hardly occurs.

In this case, if the time t2 in FIG. 18 is controlled to be the same as the time t11 in FIG. 17, it is possible to prevent printing speed from being reduced.

As described above, when the nozzles 4 are arranged so as to be displaced from each other in the direction orthogonal to the nozzle arrangement direction, it is preferable that the number of the nozzle rows be two and the distance L between the nozzle rows be (n+½) times as large as the pitch p where n is an integer. If the number of the nozzle rows is too large, it becomes hard to control the ejection of liquid droplets. The nozzles in two rows cause no problem. Furthermore, as shown in FIGS. 18A and 18B, if the distance L between the nozzle rows is (n+½) times (1.5 times in the example in FIGS. 18A and 18B) as large as the pitch p, the interval of the two nozzle rows from which liquid droplets are alternately ejected becomes constant (timing at which liquid droplets are ejected in such a manner as to be displaced by an amount of 0.5 dot). As a result, it becomes easier to control the operation.

In this case, as shown in FIG. 15, it is preferable that the two adjacent nozzles 4 be arranged in the same direction of the liquid chambers 6 relative to the piezoelectric element columns 12A. In other words, in the example shown in FIG. 15, the nozzle rows 4A and 4B are arranged at upper areas in FIG. 15 relative to the piezoelectric element columns 12A arranged in the horizontal direction of the page. With this arrangement, it is possible to reduce space required for the arrangement of the liquid chambers 6 and downsize the liquid ejection head. However, shapes around the liquid chambers 6 including the arrangement of the nozzles 4 and the piezoelectric element columns 12A are different between the adjacent liquid chambers 6. For example, in FIG. 15, a distance between the piezoelectric element columns 12A and the nozzles 4 is different depending on the nozzle rows 4A and 4B. Accordingly, if liquid droplet ejection performance of the liquid ejection head is varied, it is only necessary to correct a driving waveform to be applied to the piezoelectric element columns 12A.

Figure 19:
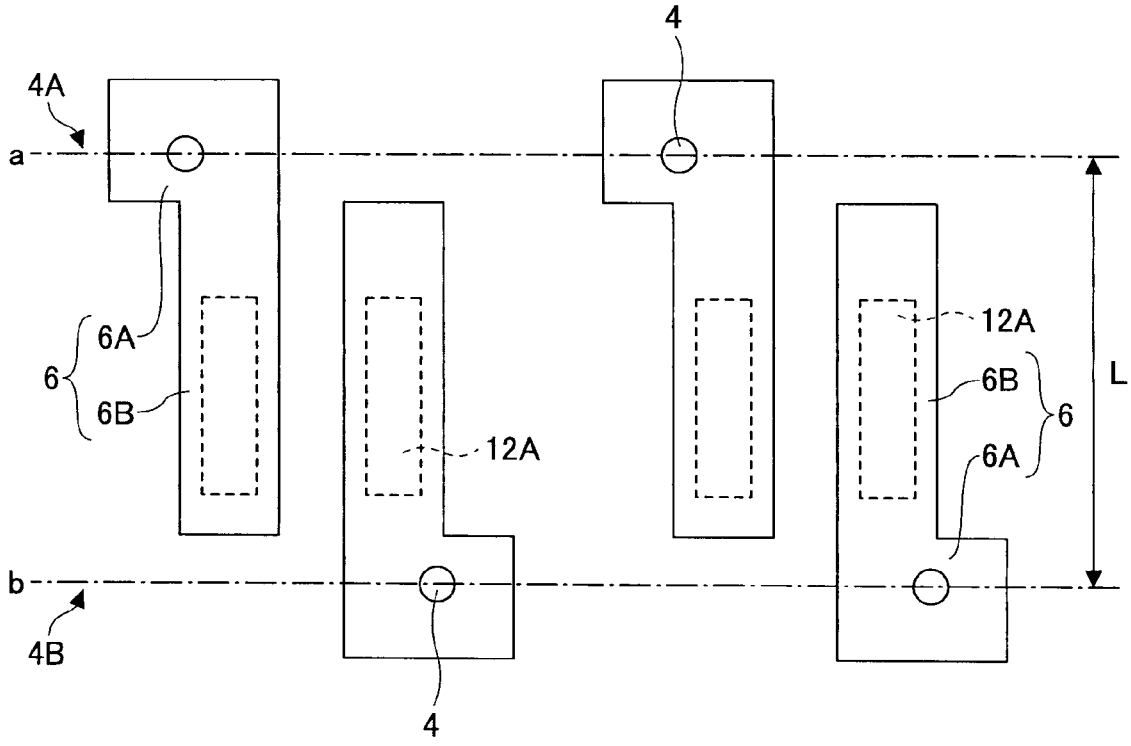
FIG. 19 is a plan view showing the shapes of the liquid chambers of the liquid ejection head according to a tenth embodiment of the present invention.

Referring next to FIG. 19, a tenth embodiment of the liquid ejection head according to the present invention is described. Note that FIG. 19 is a plan view showing the shapes of the liquid chambers 6 of the liquid ejection head.

In this embodiment, unlike the liquid chambers of the eighth embodiment, the liquid chamber parts 6A corresponding to the nozzles 4 are arranged in an opposite direction (on the opposite sides) relative to the liquid chamber parts 6B corresponding to the adjacent piezoelectric element columns 12A.

With this configuration, the adjacent liquid chambers 6 are oriented in an opposite direction, but they are the same in shape. Therefore, it is possible to obtain uniform liquid droplet ejection performance, and the operation of correcting a driving waveform is not required.

Next, examples of the present invention are described in detail.

Example 1

The same liquid ejection head as that of the second embodiment (FIGS. 5 and 6) was manufactured.

First, in order that the nozzles 4 were arranged in the flow path plate 1 using silicone (Si) at a density of 300 dpi, the liquid chambers 6 were formed so as to correspond to 128 bits (128 nozzles). On this occasion, the liquid chambers 6 formed by the flow path plate 1 had a double-layered structure of the liquid chamber parts 6A and 6B, the layer of the liquid chamber parts 6B on the side of the vibration plate member 3 had a height of 50 μm, a length L1 of 2000 μm in a longitudinal direction, and a width W1 of 50 μm in a lateral direction. The layer of the liquid chamber parts 6A on the side of the nozzles 4 had a height of 350 μm, a length L2 of 200 μm, and a width W2 of 50 μm. The liquid chamber parts 6A on the side of the nozzles 4 had dimensions of 50 μm×200 μm and were penetrated into the vibration plate member 3. The penetrated parts between the liquid chamber parts 6A and the vibration plate member 3 had dimensions of 50 μm (in width)×400 μm (in height)×200 μm (in length). Furthermore, the length of a displacement T2 (a displacement between the upper layer and the lower layer) between the liquid chamber parts 6A and 6B was 25.4 μm, and the length of a displacement T1 was 8.4 μm.

Then, the piezoelectric element columns 12A made of lead zirconate titanate were attached to the flow path plate 3. A piezoelectric element member had a 16-layer arrangement structure in which electrodes made of silver and palladium were sandwiched at the upper and lower areas, respectively. Each of the layers had a thickness of 25 μm, and inactive regions having a thickness of 80 μm and inactive regions having a thickness of 220 μm were arranged at the upper and lower parts of the piezoelectric element columns 12A, respectively. Furthermore, the length of the piezoelectric element columns 12A in its longitudinal direction was 1800 μm, and the width of the piezoelectric element columns 12A in its lateral direction was 40 μm. The width of active regions was 1500 μm, and the width of the inactive regions was 150 μm on both sides. The piezoelectric element columns 12A and the supporting columns 12B were arranged at a density of 375 dpi.

COMPARATIVE EXAMPLE 1

Figure 24:
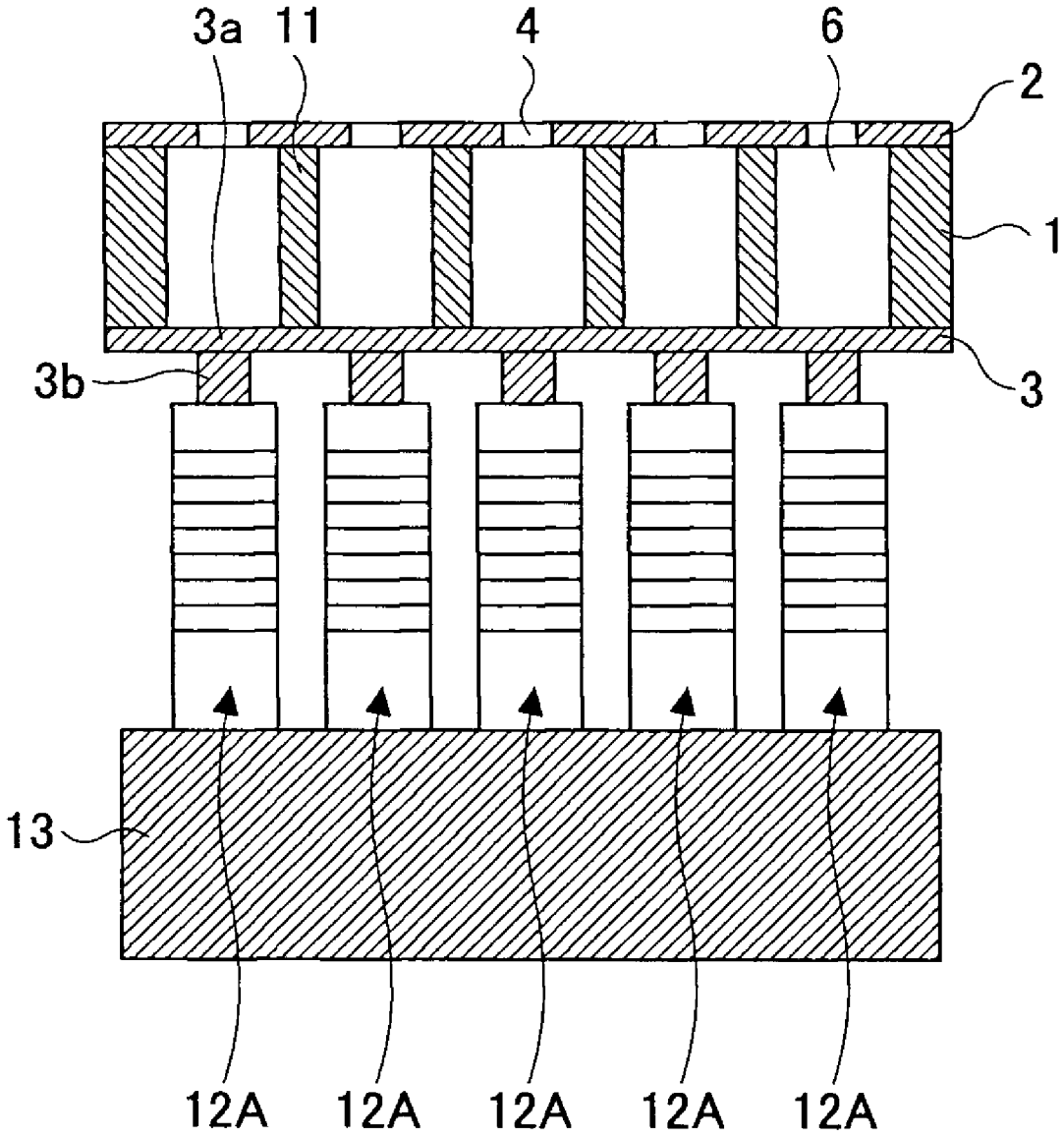
FIG. 24 is a cross-sectional view for explaining a liquid ejection head having a normal-pitch structure.

As shown in FIG. 24, the liquid ejection head having the same liquid chamber dimensions as those of Example 1 and a density of 300 dpi was manufactured with a normal pitch structure in which the supporting columns were not provided.

The liquid ejection heads of Example 1 and Comparative Example 1 were mounted on a printer, and a printing test was conducted. As a result of comparison, it was found that the printer having the liquid ejection head of Comparative Example 1 caused a printing failure, while the printer having the liquid ejection head of Example 1 caused no printing failure and showed the characteristic improvement effects according to the embodiments of the present invention.

Example 2

The same liquid ejection head as that of the eighth embodiment (FIGS. 12 and 13) was manufactured.

First, in order that the nozzles 4 were arranged in the flow path plate 1 using silicone (Si) at a density of 200 dpi, the liquid chambers 6 were formed so as to correspond to 128 bits (128 nozzles). In this case, when the surface of the vibration plate member 3 was viewed from the surface of the nozzle plate 2, the liquid chambers 6 had an L-shaped structure as shown in FIG. 14. In the dimensions of the liquid chambers 6, L3 was 2000 μm, L4 was 100 μm, W3 was 60 μm, W4 was 102.5 μm, and T3 (=T4) was 24.5 μm. In addition, the height of the liquid chambers 6 in the vertical direction of the page was 80 μm.

Then, the piezoelectric element columns 12A made of lead zirconate titanate were attached to the flow path plate 3. The piezoelectric element member had a 16-layer arrangement structure in which electrodes made of silver and palladium were sandwiched at the upper and lower areas, respectively. Each of the layers had a thickness of 25 μm and inactive regions having a thickness of 80 μm and inactive regions having a thickness of 220 μm were arranged at the upper and lower parts of the piezoelectric element columns 12A, respectively. Furthermore, the length of the piezoelectric element columns 12A in its longitudinal direction was 1800 μm, and the width of the piezoelectric element columns 12A in its lateral direction was 50 μm. The width of active regions was 1500 μm, and the width of the inactive regions was 150 μm on both sides. The piezoelectric element columns 12A and the supporting columns 12B were arranged at a density of 300 dpi.

COMPARATIVE EXAMPLE 2

As shown in FIG. 24, the liquid ejection head, in which the liquid chambers were 80 μm in height, 2100 μm in length in the longitudinal direction, 60 μm in width in the lateral direction, and had a density of 200 dpi, was manufactured with the normal pitch structure in which the supporting columns were not provided.

The liquid ejection heads of Example 2 and Comparative Example 2 were mounted on the printer, and a printing test was conducted. As a result of comparison, it was found that the printer having the liquid ejection head of Comparative Example 2 caused a printing failure, while the printer having the liquid ejection head of Example 2 caused no printing failure and showed the characteristic improvement effects according to the embodiments of the present invention.

Example 3

Figure 20:
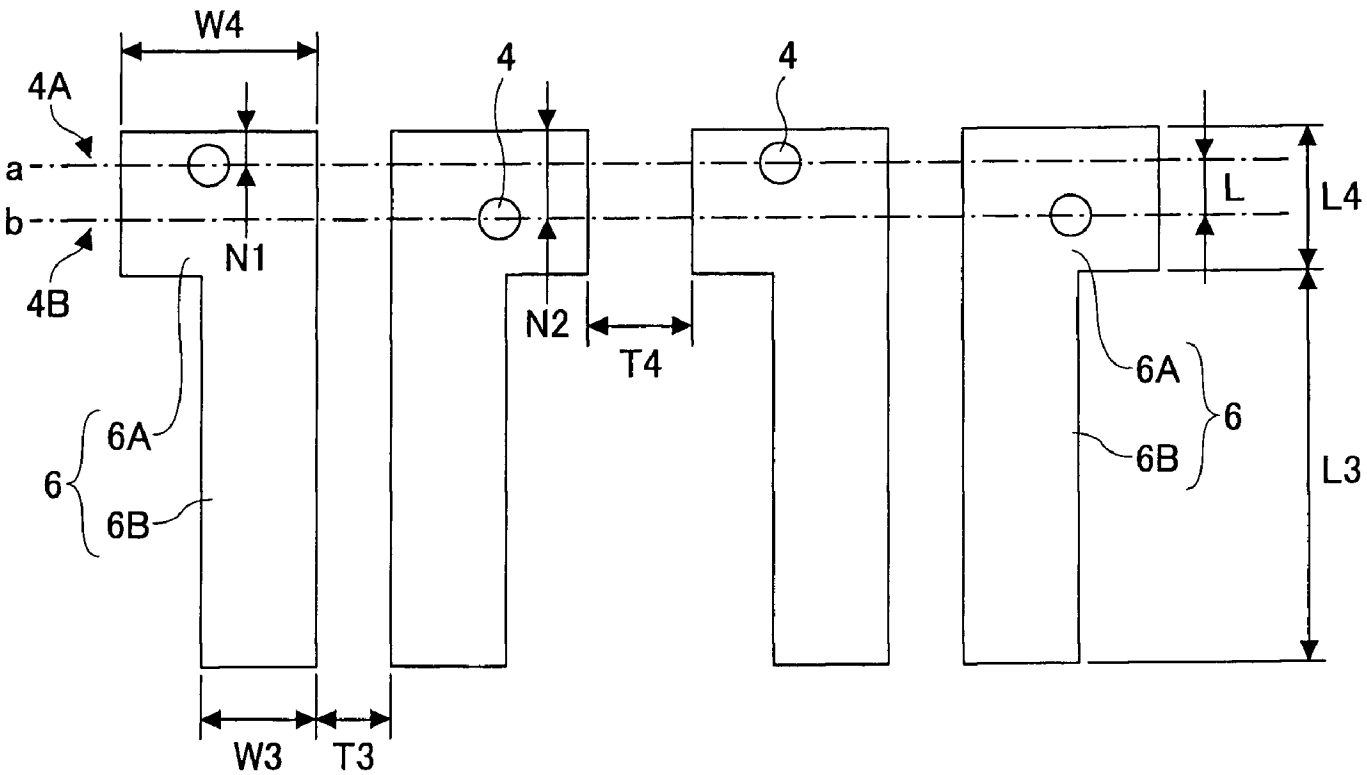
FIG. 20 is a view showing the shapes of the liquid chambers for explaining specific examples of the present invention.

The liquid ejection head having the configuration shown in FIG. 20 was manufactured. The liquid ejection head shown in FIG. 20 was obtained in such a manner that the adjacent nozzles 4 in the liquid ejection head of the eighth embodiment were displaced from each other in the direction orthogonal to the nozzle arrangement direction as in the liquid ejection head of the ninth embodiment.

First, in order that the nozzles 4 were arranged in the flow path plate 1 using silicone (Si) at a density of 200 dpi, the liquid chambers 6 were formed so as to correspond to 128 bits (128 nozzles). In this case, when the surface of the vibration plate member 3 was viewed from the surface of the nozzle plate 2, the liquid chambers 6 had an L-shaped structure as shown in FIG. 20. In the dimensions of the liquid chambers 6, L3 was 1900 μm, L4 was 300 μm, W3 was 60 μm, W4 was 102.5 μm, T3 (=T4) was 24.5 μm, N1 was 100 μm, and N2 was 174 μm. However, N1 and N2 were the distances between the ends of the liquid chambers 6 and the center of the nozzles 4. In addition, the height of the liquid chambers 6 in the vertical direction of the page was 80 μm.

Then, the piezoelectric element columns 12A made of lead zirconate titanate were attached to the flow path plate 3. The piezoelectric element member had a 16-layer arrangement structure in which electrodes made of silver and palladium were sandwiched at the upper and lower areas, respectively. Each of the layers had a thickness of 25 μm, and inactive regions having a thickness of 80 μm and inactive regions having a thickness of 220 μm were arranged at the upper and lower parts of the piezoelectric element columns 12A, respectively. Furthermore, the length of the piezoelectric element columns 12A in its longitudinal direction was 1800 μm, and the width of the piezoelectric element columns 12A in its lateral direction was 50 μm. The width of active regions was 1500 μm, and the width of the inactive regions was 150 μm on both sides. The piezoelectric element columns 12A and the supporting columns 12B were arranged at a density of 300 dpi.

The liquid ejection head of Example 3 was mounted on the printer, and a printing operation was performed at a density of 1200 dpi. The pitch between dots when the printing operation was performed at a density of 1200 dpi was 21.17 μm. In the liquid ejection head of Example 3, the adjacent nozzles 4 were arranged so as to be displaced from each other by an amount of 74 μm, 3.5 times as large as the pitch in the direction orthogonal to the nozzle arrangement direction.

COMPARATIVE EXAMPLE 3

As shown in FIG. 24, the liquid ejection head, in which the liquid chambers were 80 μm in height, 2200 μm in length in the longitudinal direction, 60 μm in width in the lateral direction, and had a density of 200 dpi, was manufactured with the normal pitch structure in which the supporting columns were not provided.

The liquid ejection head of Comparative Example 3 was mounted on the printer, and a printing operation was performed.

As a result of comparison, it was found that the printer having the liquid ejection head of Comparative Example 3 caused a printing failure, while the printer having the liquid ejection head of Example 3 caused no printing failure and showed the characteristic improvement effects according to the embodiments of the present invention.

Note that in the above Examples, the piezoelectric element member was fully cut so as to form the piezoelectric element columns 12A and the supporting columns 12B. However, the piezoelectric element member may be cut by half so that the piezoelectric element columns 12A and the supporting columns 12B were connected to each other via the inactive regions.

Figure 21:
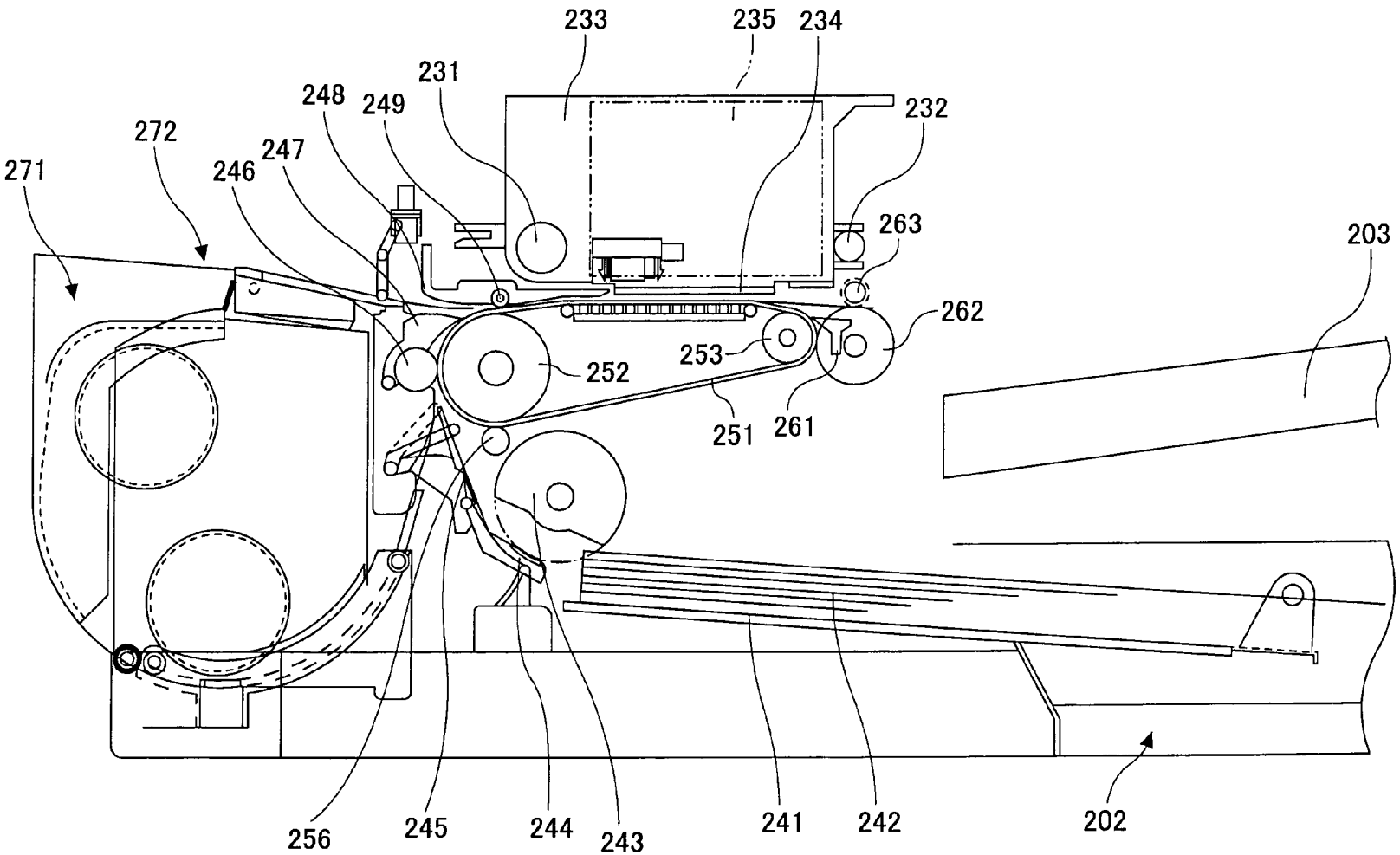
FIG. 21 is an entire configuration view showing an example of an image forming apparatus according to the embodiments of the present invention.
Figure 22:
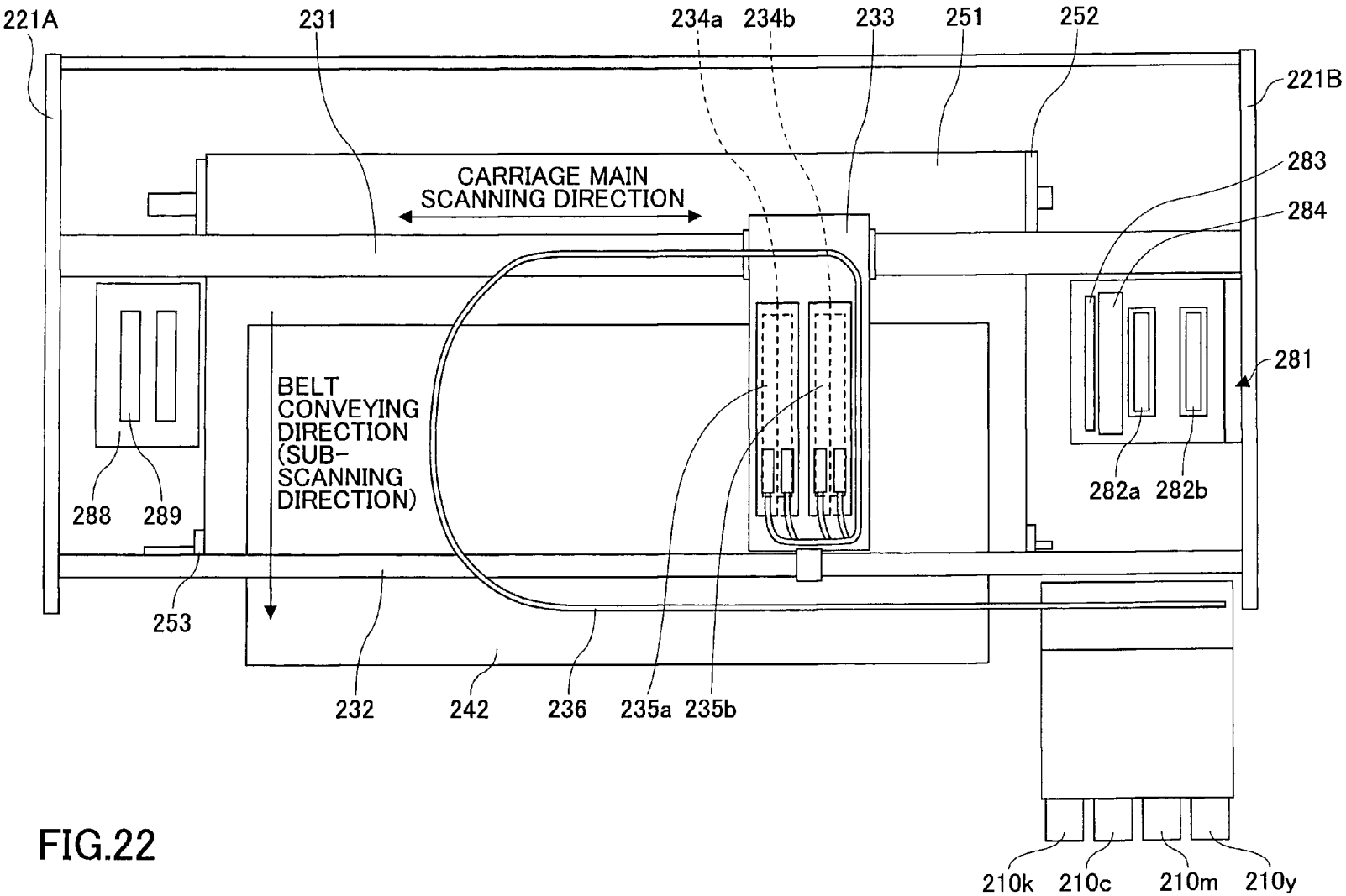
FIG. 22 is a plan view of a substantial part of the image forming apparatus according to the embodiments of the present invention.

Referring next to FIGS. 21 and 22, a description is made of an example of an image forming apparatus on which the liquid ejection head according to the embodiments of the present invention is mounted.

The image forming apparatus is of a serial type in which a carriage 233 is slidably held in a main scanning direction with guide rods 231 and 232 serving as guide members laterally bridged between right and left side plates 201A and 201B. The carriage 233 is caused to move for scanning in the direction as indicated by an arrow through a timing belt driven by a main scanning motor (not shown).

In the carriage 233, there are installed recording heads 234*a* and 234*b* (hereinafter referred to as a "recording head 234" when they are not discriminated) composed of the liquid ejection heads according to the embodiments of the present invention that eject respective colors (yellow (Y), cyan (C), magenta (M), and black (K)) of ink droplets. In this case, nozzle rows each having plural nozzles are arranged in the sub-scanning direction orthogonal to the main-scanning direction, and the ejecting direction of the ink droplets is downward.

The recording head 234 has two nozzle rows each. The recording head 234*a* causes black (K) liquid droplets to be ejected from the nozzles of one nozzle row and cyan (C) liquid droplets to be ejected from those of the other nozzle row. The recording head 234*b* causes magenta (M) liquid droplets to be ejected from the nozzles of one nozzle row and yellow (Y) liquid droplets to be ejected from those of the other nozzle row. Note that here four colors of liquid droplets are ejected from the two recording heads 234*a* and 234*b*. However, the recording heads for each color may be provided, and one recording head having nozzle rows composed of plural nozzles for ejecting four colors of liquid droplets may be provided.

Furthermore, the carriage 233 has sub-tanks 235*a* and 235*b* (hereinafter referred to as a "sub-tank 235" when they are not discriminated) mounted thereon for supplying the respective colors of ink corresponding to the nozzle rows of the recording head 234. The colors of ink are replenished and supplied by a supplying unit 224 from respective colors of ink cartridges 210 to the sub-tank 235 through corresponding colors of supplying tubes 236.

As parts of a sheet feeding unit that feeds sheets 242 stacked on a sheet loading part (pressure plate) 241 of a sheet feeding tray 202, there are provided a semi-circular roller (sheet feeding roller) 243 that separates the sheets 242 one by one from the sheet loading part 241 and feeds the same and a separation pad 244 that faces the sheet feeding roller 243 and is made of a material having a large friction coefficient. The separation pad 244 is biased to the side of the sheet feeding roller 243.

Furthermore, as parts of a conveyance unit that conveys the sheet 242 fed from the sheet feeding unit to the lower side of the recording head 234, there are provided a guide member 245 that guides the sheet 242, a counter roller 246, a conveyance guide member 247, a pressing member 248 having a tip-end pressurizing roller 249, and a conveyance belt 251 as a conveyance unit that electrostatically attracts the fed sheet 242 and conveys the same to the position where it faces the recording head 234.

The conveyance belt 251 is an endless belt, which is bridged between a conveyance roller 252 and a tension roller 253 and rotates in the belt conveying direction (sub-scanning direction). In addition, there is provided a charging roller 256 as a charging unit that charges the front surface of the conveyance belt 251. The charging roller 256 is brought into contact with the front layer of the conveyance belt 251 and arranged to rotate in conjunction with the rotation of the conveyance belt 251. The conveyance belt 251 rotates in the belt conveying direction when the conveyance roller 252 is rotated and driven by a sub-scanning motor (not shown) with timing.

Moreover, as parts of a sheet discharging unit that discharges the sheet 242 recorded by the recording head 234, there are provided a separation claw 261 that separates the sheet 242 from the conveyance belt 251, a sheet discharging roller 262, a sheet discharging roller 263, and a sheet catching tray 203 arranged below the sheet discharging roller 262.

Furthermore, a double-sided unit 271 is detachably attached to the back surface side of an apparatus main body. The double-sided unit 271 receives the sheet 242 returned when the conveyance belt 251 is rotated in the reverse direction and turns the same upside down, and then it feeds the inverted sheet 242 to the area between the counter roller 246 and the conveyance belt 251 again. Furthermore, the top surface of the double-sided unit 271 serves as a manual sheet feeding tray 272.

Moreover, in a non-printing area on one side in the scanning direction of the carriage 233, there is provided a maintenance and recovery mechanism 281 that maintains and restores the condition of the nozzles of the recording head 234. The maintenance and recovery mechanism 281 has cap members 282*a* and 282*b* (hereinafter referred to as a "cap 282" when they are not discriminated) that cap the nozzle surfaces of the recording head 234, a wiper blade 283 serving as a blade member that wipes out the nozzle surfaces, an idle-ejection receiver 284 that receives liquid droplets ejected when an idle ejection for ejecting the liquid droplets that do not contribute to recording is performed so as to eject a thickened recording liquid, etc.

Furthermore, in the non-printing area on the other side in the scanning direction of the carriage 233, there is provided an ink collection unit (idle-ejection receiver) 288 serving as a liquid collection container that receives liquid droplets ejected when an idle ejection for ejecting the liquid droplets that do not contribute to recording is performed so as to eject a thickened recording liquid during the recording. The ink collection unit 288 has, for example, an opening part 289 along the direction of the nozzle rows of the recording head 234.

In the image forming apparatus thus configured, the sheets 242 are separated and fed one by one from the sheet feeding tray 202. Then, the sheet 242 fed in a substantially vertical direction is guided by the guide member 245 and conveyed in such a manner as to be held between the conveyance belt 251 and the counter roller 246. After that, the sheet 242 is pressed against the conveyance belt 251 by the tip-end pressurizing roller 249 with its tip end guided by the conveyance guide member 249 and caused to change its conveyance direction by approximately 90 degrees.

At this time, an alternating voltage is applied to the charging roller 256 so that positive and negative outputs are alternately repeated. As a result, the conveyance belt 251 is charged with an alternating charged voltage pattern. In other words, positive and negative voltages are alternately applied onto the conveyance belt 251 in a strip shape with a predetermined width in the sub-scanning direction as the rotating direction of the charging roller 256. When the sheet 242 is fed onto the conveyance belt 251 onto which the positive and negative voltages are alternately applied, it is attracted onto the conveyance belt 251 and conveyed in the sub-scanning direction in conjunction with the rotation of the conveyance belt 251.

When the recording head 234 is driven in accordance with image signals as the carriage 233 moves, ink droplets are ejected onto the sheet 242 so as to perform recording for one row. After the sheet 242 is conveyed by a predetermined amount, it undergoes recording for the next row. When receiving a recording end signal or a signal indicating that the rear end of the sheet 242 has reached a recording area, the image forming apparatus ends the recording operation and discharges the sheet 242 to the sheet catching tray 203.

As described above, with the liquid ejection head according to the embodiments of the present invention, the image forming apparatus can stably eject liquid droplets even when it is driven at high speed. In addition, it can realize high speed printing and high image quality.

Note that according to above embodiments the present invention is applied to the image forming apparatus having a printer configuration. However, without being limited to this, it can be applied to image forming apparatuses such as printers, facsimile machines, copiers, or multi-task machines.

The present invention is not limited to the specifically disclosed embodiments, and variations and modifications may be made without departing from the scope of the present invention.

The present application is based on Japanese Priority Application No. 2008-016709 filed on Jan. 28, 2008, the entire contents of which are hereby incorporated herein by reference.

What is claimed is:

1. A liquid ejection head comprising:

a flow path member having provided therein plural liquid chambers respectively in communication with plural nozzles that eject a liquid droplet, the plural nozzles being arranged in nozzle rows in a nozzle arrangement direction, each nozzle row including three or more nozzles arranged side by side in the nozzle arrangement direction with a same nozzle pitch between each pair of adjacent nozzles in the nozzle arrangement direction;

a vibration plate member that forms at least a part of wall surfaces of the liquid chambers;

plural piezoelectric element columns that deform the vibration plate member at positions corresponding to the liquid chambers;

a supporting column that corresponds to a partition wall sandwiched between the liquid chambers; and a base member on which the plural piezoelectric element columns and the supporting column are arranged; wherein the supporting column is arranged so as to be sandwiched between a group of two or more of the consecutive piezoelectric element columns in the nozzle arrangement direction in which said each pair of adjacent nozzles in the nozzle arrangement direction has the same nozzle pitch therebetween.

2. The liquid ejection head according to claim 1, wherein two or more of the piezoelectric element columns are arranged so as to be sandwiched between two of the supporting columns.

3. The liquid ejection head according to claim 1, wherein an arrangement interval of the nozzles is different from an arrangement interval of the piezoelectric element columns.

4. The liquid ejection head according to claim 3, wherein the liquid chambers have a part facing the nozzle and a part facing the piezoelectric element column.

5. The liquid ejection head according to claim 4, wherein the liquid chambers incline toward the part facing the piezoelectric element column from the part facing the nozzle.

6. The liquid ejection head according to claim 4, wherein two of the piezoelectric element columns are arranged between two of the supporting columns and axisymmetrically arranged.

7. The liquid ejection head according to claim 1, wherein the plural nozzles are arranged so as to be displaced from each other in a direction orthogonal to the nozzle arrangement direction, and a distance in the direction orthogonal to the nozzle arrangement direction is not an integral multiple of a pitch between recording dots when a recording operation is performed with the liquid ejection head.

8. The liquid ejection head according to claim 7, wherein the plural nozzles are arranged in two rows in a staggered manner, and a distance L in the direction orthogonal to the nozzle arrangement direction is expressed by a formula $L=p\times(n+1/2)$ where n is an integer and p is the pitch between the recording dots.

9. The liquid ejection head according to claim 8, wherein the nozzles in one row and the nozzles in the other row are arranged on a same side of the liquid chambers relative to an arrangement of the piezoelectric element columns.

10. The liquid ejection head according to claim 8, wherein the nozzles in one row and the nozzles in the other row are arranged on opposite sides of the liquid chambers relative to an arrangement of the piezoelectric element columns.

11. The liquid ejection head according to claim 1, wherein the plural nozzles are arranged at equal intervals in the nozzle arrangement direction.

12. The liquid ejection head according to claim 1, wherein the supporting column supports the flow path member.

13. The liquid ejection head according to claim 1, wherein the supporting column is a piezoelectric element member.

14. The liquid ejection head according to claim 1, wherein the nozzle arrangement direction is a nozzle alignment direction, and the plural nozzles are aligned in the nozzle alignment direction.

15. An image forming apparatus having at least one liquid ejection head, the liquid ejection head comprising:

a flow path member having provided therein plural liquid chambers respectively in communication with plural nozzles that eject a liquid droplet, the plural nozzles being arranged in nozzle rows in a nozzle arrangement direction, each nozzle row including three or more nozzles arranged side by side in the nozzle arrangement direction with a same nozzle pitch between each pair of adjacent nozzles in the nozzle arrangement direction;

a vibration plate member that forms at least a part of wall surfaces of the liquid chambers;

plural piezoelectric element columns that deform the vibration plate member at positions corresponding to the liquid chambers;

a supporting column that corresponds to a partition wall sandwiched between the liquid chambers; and a base member on which the plural piezoelectric element columns and the supporting column are arranged; wherein the supporting column is arranged so as to be sandwiched between a group of two or more of the consecutive piezoelectric element columns in a nozzle arrangement direction in which said each pair of adjacent nozzles in the nozzle arrangement direction has the same nozzle pitch therebetween.

16. The image forming apparatus according to claim 15, wherein the plural nozzles are arranged at equal intervals in the nozzle arrangement direction.

* * * * *